US008584917B2

(12) United States Patent
Hexels

(10) Patent No.: US 8,584,917 B2
(45) Date of Patent: Nov. 19, 2013

(54) CARRIER SYSTEM HAVING A FRONT AND BACK PART AND MEANS FOR FASTENING TO A HUMAN TORSO

(75) Inventor: Gerd Hexels, Nettetal (DE)

(73) Assignee: Hexonia GmbH, Nettetal (DE)

( * ) Notice: Subject to any disclaimer, the term of this patent is extended or adjusted under 35 U.S.C. 154(b) by 148 days.

(21) Appl. No.: 13/068,658

(22) Filed: May 16, 2011

(65) Prior Publication Data

US 2012/0024924 A1 Feb. 2, 2012

(30) Foreign Application Priority Data

May 17, 2010 (DE) ..... 10 2010 029 035

(51) Int. Cl.
*A45F 3/06* (2006.01)

(52) U.S. Cl.
USPC ..... 224/637; 224/262; 224/650; 224/576; 2/102; 2/2.5

(58) Field of Classification Search
USPC ..... 224/148.3, 634, 271, 633, 242, 261, 224/262, 263, 265, 583, 637, 645, 629, 675, 224/665, 653, 650, 272; 2/2.5, 102, 463, 2/462; 24/306, 573.09, 578.1
See application file for complete search history.

(56) References Cited

U.S. PATENT DOCUMENTS

| | | | | |
|---|---|---|---|---|
| 4,154,381 | A * | 5/1979 | Zufich | 224/262 |
| 5,628,443 | A * | 5/1997 | Deutsch | 224/583 |
| 5,732,867 | A * | 3/1998 | Perkins et al. | 224/628 |
| 5,774,338 | A * | 6/1998 | Wessling, III | 361/730 |
| 6,840,419 | B2 * | 1/2005 | Penny et al. | 224/637 |
| 7,232,049 | B2 * | 6/2007 | Meyer | 224/637 |
| 7,644,847 | B2 * | 1/2010 | Howell | 224/635 |
| 8,079,503 | B1 * | 12/2011 | Yeates et al. | 224/666 |
| 2002/0120973 | A1 | 9/2002 | D'Annunzio | |
| 2007/0175941 | A1 * | 8/2007 | Berry et al. | 224/583 |
| 2009/0282595 | A1 * | 11/2009 | Branson et al. | 2/2.5 |
| 2010/0025560 | A1 * | 2/2010 | Beck | 248/558 |
| 2012/0180178 | A1 * | 7/2012 | Gallo | 2/2.5 |
| 2012/0192335 | A1 * | 8/2012 | Crye | 2/102 |

FOREIGN PATENT DOCUMENTS

| | | | |
|---|---|---|---|
| DE | 102004023665 | A1 * | 12/2004 |
| EP | 2 052 632 | A1 | 4/2009 |
| EP | 1 994 841 | B1 | 9/2009 |
| EP | 2 016 843 | B1 | 1/2011 |

OTHER PUBLICATIONS

Machine Translation of DE 102004023665 (Dec. 2004).*

* cited by examiner

*Primary Examiner* — Nathan J Newhouse
*Assistant Examiner* — Phillip Schmidt
(74) *Attorney, Agent, or Firm* — Paine Hamblen, LLP

(57) ABSTRACT

The invention relates to a carrier system having a front part and a back part first and second means for fastening to a human torso, and a hip belt which can be connected to the back part via at least one support, and wherein the first and the second fastening means together form a fastening device with fastening loops and receptacles and the fastening loops can be inserted into or passed through the receptacles, and an elongated fixing element is provided which can be passed through those ends of the fastening loops which have been inserted into the receptacles.

2 Claims, 20 Drawing Sheets

CARRIER SYSTEM HAVING A FRONT AND BACK PART AND MEANS FOR FASTENING TO A HUMAN TORSO

PRIORITY CLAIM

This patent application claims priority to German Patent Application Serial No. 10 2010 029035.1, and which was filed on May 17, 2010.

BACKGROUND OF THE INVENTION

1. Field of the Invention

The invention relates to a carrier system having a front part and a back part and means for fastening to a human torso, according to the preamble of Claim 1.

2. Description of the Related Art

From the general prior art, carrier systems are known which have a front part and a back part and which are generally of ballistic design and referred to as ballistic protective vests or armoured or projectile-stopping protective vests. Ballistic protective vests for wearing on the body are usually used by military and police forces to protect persons against attacks involving stabbing weapons or projectiles.

To ensure ballistic protection, the protective vests for wearing on the body generally have a projectile-inhibiting composite composed of a plurality of layers. Here, a distinction is made substantially between so-called soft ballistic and hard ballistic protective packages.

The known ballistic protective vests generally have a front part and a back part which are intended to offer protection against stabbing weapons and/or against firearms.

A generic carrier system is known from EP 2 052 632 A1. Here, the carrier system is composed substantially of three components, specifically firstly a ballistic protective vest having a front part and a back part and means for fastening to a human torso. Secondly, the carrier system has a hip belt which can be arranged around the hips of a person, and thirdly, the carrier system has two lateral supports which connect the hip belt to the rear shield-shaped region of the ballistic protective vest, that is to say the back part thereof. Electronic components, for example a radio unit, may be integrated in the back part of the ballistic protective vest.

The hip belt known from the generic document with the lateral supports facilitates the wearing of a protective vest without excessively restricting the freedom of movement of the wearer. Furthermore, the lateral support may if required be designed so as to convert a relative movement, which a person generates between the hip and torso while walking, into an electrical current. For this purpose, reference is made also to EP 1 994 841 B1, which claims such a design.

The protective vest known from EP 2 052 632 A1 in combination with the hip belt has proven to be particularly suitable for military and police uses and applications.

In the case of the described carrier systems, it is particularly essential that these can be quickly abandoned or discarded in an emergency.

SUMMARY OF THE INVENTION

The present invention is based on the object of improving the carrier systems known from the prior art, in particular the carrier systems of ballistic design, such that they can be removed easily, reliably and quickly from a human torso.

Said object is achieved according to the invention by means of Claim 1.

The carrier system according to the invention has a front part and a back part and means for fastening to a human torso. Also provided is a hip belt which can be connected to the back part via at least one support.

In a general embodiment of the invention, the physical design of the support which connects the hip belt to the back part is not of importance. Two embodiments have however proven to be particularly suitable. In both embodiments, it may be provided that the support is designed to transmit weight loads from the back part to the hip belt. In a first embodiment, the support may be formed on the rear side of the hip belt and run up the back along a human spine when the hip belt is correctly fastened, wherein the upper region, which faces away from the hip belt, of the support can be connected to the back part. Here, the support may be designed so as to permit a relative pivoting movement between the back part and the hip belt about a pivot axis running perpendicular to the back part. The support may be releasably attached to the back part, for example by means of a screw connection, a clip connection or by hook-and-loop fasteners which attach the support to the back part. The connection of the support to the back part may preferably take place in a positively locking manner.

In a second embodiment of the support, the latter may be designed as a lateral support. Here, lateral is to be understood to mean that the support is fastened to the hip belt to the left and/or right of the body of a person when the generic carrier system is worn correctly. Two lateral supports are preferably provided which are fastened to the hip belt in each case to the left and right of the body of a person.

It is also provided according to the invention that at least one part of the means for fastening to a human torso has first fastening means and the back part has second fastening means, wherein the first and the second fastening means together form a fastening device with fastening loops and receptacles. Here, the receptacles are provided with slots. In a general embodiment of the invention, it is not of primary importance whether the first fastening means are fastening loops or receptacles and the second fastening means are designed correspondingly. In a general embodiment of the invention, it is essential merely that the first and the second fastening means together form a fastening device with fastening loops and receptacles which, according to the invention, can be connected to one another with the aid of an elongate fixing element, preferably a pintle wire or the like. According to the invention, it is provided in a general embodiment that the fastening loops can be inserted into or passed through the receptacles. Furthermore, an elongate fixing element is provided which can be passed through those ends of the fastening loops which have been inserted into the receptacles or through those ends of the fastening loops which have been passed through the receptacles. Here, the slot, the fastening loops and the elongate fixing element are designed such that the fastening loops, after the elongate fixing element has been passed through, can no longer pass out through the slot, wherein the elongate fixing element has an operating part for pulling the fixing element out of the fastening loops.

Below, an embodiment of the invention will be described in more detail in which the first fastening means are designed as fastening loops and the second fastening means are designed as receptacles with slots. However, unless ruled out from a design aspect, all the features and exemplary embodiments described below, in particular also the description of the figures, may also be realized such that the first fastening means are designed as receptacles with slots and the second fastening means are designed as fastening loops. Furthermore, below, exemplary embodiments are presented in which the support is realized as a lateral support. However—unless positively ruled out from a design aspect—said support may also be any desired type of support, in particular a support such as that described above according to the first embodiment. All the exemplary embodiments, in particular also the description of the figures, should therefore be understood to mean that the lateral supports may also be replaced by the supports according to the first embodiment.

In a preferred embodiment, the carrier system according to the invention has a front part and a back part and means for fastening to a human torso. The carrier system also has a hip belt which can be connected to the back part via at least one lateral support. It is provided according to the invention that at least a part of the means for fastening to a human torso has fastening loops and that the back part has receptacles provided with slots, it being possible for the fastening loops to be inserted into the receptacles, and an elongate fixing element being provided which can be passed through those ends of the fastening loops which have been inserted into the receptacles, and the slot, the fastening loops and the elongate fixing element being designed such that the fastening loops, after the elongate fixing element has been passed through, can no longer pass out through the slots, the elongate fixing element having an operating part for pulling the fixing element out of the fastening loops.

The inventor has recognized that the means for fastening to a human torso can be connected to and released from the back part of the carrier system in a particularly advantageous manner if, for this purpose, a fastening system is selected which is composed substantially of fastening loops, a receptacle with slots and an elongate fixing element. Here, the elongate fixing element may be a wire, in particular a pintle wire or a cable or similar elongate element. In this respect, within the context of the invention, where a "pintle wire" is mentioned, this should be understood to also mean any type of wires and/or cables or similar elongate elements, which should also be regarded as being disclosed.

The expression "fastening loops" is to be understood generally to mean that a substantially closed material arrangement is provided into which the elongate fixing element can be inserted. Here, the material arrangement may also have discontinuities or openings, as long as it is ensured that the elongate fixing element cannot escape radially. The material arrangement may for this purpose form, as viewed in the axial direction, a tube or tunnel section for receiving the elongate fixing element.

The particular advantage of the solution according to the invention is that the means for fastening to a human torso can be separated from the back part particularly easily. This is advantageous in particular for military applications. The person using the carrier system can quickly and easily abandon or discard said carrier system if required or in an emergency. By simply pulling out or removing the elongate fixing element (in particular the pintle wire) from the fastening loops, the locking action which prevents the fastening loops from passing out of the receptacles through the slot is eliminated. That is to say, when the elongate fixing element has been removed, the fastening loops can be removed through the slot of the receptacles. The connection between the means for fastening to a human torso and the back part is thereby released, such that the back part falls away from the means for fastening to a human torso.

The elongate fixing element can be pulled out of the fastening loops in a particularly simple manner if the elongate fixing element is provided with an operating part or comprises an operating part. The operating part may for example be a protruding or projecting end piece of the elongate fixing element. It may also be provided here that the end of the elongate fixing element has a shape which the wearer of the carrier system can particularly easily grip or grasp in order to pull the elongate fixing element out of the fastening loops. It may for example be provided that the end of the elongate fixing element is formed as a loop. The operating element may however also be designed as any type of handle, for example as a ring, a grip, a lever or the like.

Within the context of the invention, it may be provided that one or more elongate fixing elements which are passed in each case through correspondingly assigned fastening loops in order to fix or fasten these in the receptacles. It may however also be provided that only one fixing element is provided by means of which fastening loops of at least two different means for fastening to a human torso are fixed in the respectively associated receptacles and released again therefrom. The at least two means may for example be a left shoulder strap, a right shoulder strap, a left side flank or a right side flank of a fastening belt. If a plurality of elongate fixing elements are provided, an operating element may be provided for each elongate fixing element. It is however advantageous for only one control part to be formed which, if a plurality of elongate fixing elements are provided, makes it possible for said elongate fixing elements to be pulled jointly out of the fastening loops. This may be achieved for example by virtue of the elongate fixing element, embodied for example as a pintle wire, being branched. Here, the elongate fixing element may have one end which is connected to the operating part, and a plurality of ends which are produced by a branching configuration (for example by means of clamps or the like) and which are passed in each case through fastening loops. In this way, those ends of the fixing element which are passed through the fastening loops can be pulled out, preferably as simultaneously as possible, by the actuation of an operating part, such that all of the means for fastening to a human torso which are attached to the back part in this way are released simultaneously.

It is advantageous here for the means for fastening to a human torso to have at least one fastening belt, which runs preferably above a human hip, and two shoulder straps which run over a human shoulder.

It has been found to be particularly suitable if, by means of an operating element, the elongate fixing element which connects both the shoulder strap and also one end of the fastening belt to the back part can be released. For this purpose, the elongate fixing element may if appropriate have a branching configuration.

It is also advantageous if the back part comprises at least one substantially vertically running carrier strip and the fastening belt, at at least one end facing towards the carrier strip, is releasably connected to the carrier strip by means of the fastening loops and the elongate fixing element.

The carrier strip may be an independent component which can be connected to the back part or to a back plate of the back part, or may be a component which is formed in one piece with the back part or a back plate.

It is advantageous if the back part comprises a back plate which extends substantially plane-parallel to a partial area of a human back, wherein receptacles are provided on the top end of the back plate in order to releasably fasten a shoulder strap, which is provided with at least one fastening loop, to the back plate by means of an elongate fixing element.

Alternatively, the upper end of the back plate may also be provided with fastening loops for fastening at least one shoulder strap, which is provided with at least one receptacle with slots, releasably to the back plate by means of an elongate fixing element. The exemplary embodiments described below, in particular also the description of the figures, should be understood to mean that the receptacles and the fastening loops may also be provided, in a reversed arrangement, on the shoulder straps and on the back part respectively.

The inventor has recognized that it is particularly advantageous if the means for fastening to a human torso are formed by preferably two shoulder straps and one fastening belt which runs preferably above a human hip, preferably in the abdomen area. A particularly good connection of the back part to the back of the torso can be obtained in this way, and therefore said back part is comfortable to wear. It is also advantageous if one, preferably both shoulder strap(s) and/or the fastening belt are fixed in respectively associated receptacles of the back part or of the carrier strip by means of the combination of the fastening loops and the elongate fixing element. Here, it is basically conceivable for the two shoulder straps and also the fastening belt to be able to be connected to and released from the receptacles in each case by means of elongate fixing elements, preferably pintle wires, formed independently of one another. It is however advantageous for one pintle wire (or the like) to attach both the fastening belt and also the one or two shoulder straps to the back part or the carrier strip. Here, the pintle wire may also branch, and/or further wire pieces (or the like) may be fastened to the pintle wire by means of clamps. Furthermore, within the context of the solution according to the invention, it may be provided that the fastening belt, at both ends facing towards the back part, is fastened in receptacles of the back part or of the carrier strip by means of a combination of fastening loops and the pintle wire. For a fast release or discarding of the carrier system, however, it is adequate for the fastening belt to be released at one end from the back part. Here, the connection of the other fastening belt facing towards the back part may take place in any desired way.

Furthermore, it may be provided that both shoulder straps are designed such that they can be released from the back part by the removal of the pintle wire. It may however also be adequate here for only one shoulder strap to have such a connection.

It may be advantageous for the fastening loop and the elongate fixing element, after the fastening lip has been inserted into the receptacle, to form there a so-called beading. In general, a beading is to be understood to mean a thickened portion at the edge of a textile, which thickened portion is inserted into a corresponding beading rail and is held therein on account of the thickened portion. According to the invention, such a beading may be formed by virtue of the fastening loop or the fastening loops, after having been inserted into the receptacle, being thickened by the elongate fixing element, preferably a pintle wire, so as to form a beading.

The back part may preferably have for this purpose receptacles which are formed in the manner of a beading rail or a beading strip. The receptacles may preferably be formed as a tube element, for example with an at least approximately circular cross section, and have a slot extending in the longitudinal direction of the tube element. Here, the fastening loops may either be pushed into the tubular receptacle at an open face side or directly through the slot. After the insertion of the fastening loops, the fastening loops are then fixed in the receptacle by the insertion of the elongate fixing element. The elongate fixing element is for this purpose preferably inserted at a face-side end of the receptacle. An elongate fixing element may preferably be passed both through the fastening loops which connect the shoulder straps and also through the fastening loop or the fastening loops which connect(s) one end of the fastening belt to the back part. Here, it may be advantageous for the elongate fixing element to branch. This may be realized, in particular in an embodiment as a pintle wire, by means of clamps.

It is advantageous if the fastening belt has, at least at one end facing towards the carrier strip or the back part, a side part which can be releasably connected to the fastening belt and which has the fastening loop or the fastening loops for connecting to the carrier strip.

Said solution has the advantage that the side part with the fastening loops attached thereto can remain connected to the back part via the elongate fixing element, preferably in the manner of a beading, even if the actual fastening belt is released from the back part. An advantage of this embodiment is that fastening belts of different length can be attached to the side part. Different anatomies of the persons who are to wear the carrier system can therefore be taken into consideration. It is particularly advantageous here if the side part can be connected to the fastening belt at different fastening points (in relation to the length thereof). It is therefore possible for the fastening belt to be buckled more tightly or loosely and to thereby obtain optimum wearing comfort, if appropriate adapted to the items of clothing being worn under it.

For this purpose, it may be advantageous for the fastening belt and the side part to have in each case at least one row of loops, and for it to be possible for the row of loops of the fastening belt to be connected to the row of loops of the side part by means of a strip-shaped connecting element. It is advantageous here for the loops of the row of loops of the fastening belt to be arranged in each case with a spacing to one another in the vertical direction. It is also advantageous for the loops of the row of loops of the side part to likewise be arranged with a spacing to one another as viewed in the vertical direction. Here, the rows of loops of the fastening belt and of the side part are preferably formed with respect to one another such that the loops of one row of loops can be arranged in the spacings between the loops of the other row of loops, such that the strip-shaped connecting element, when inserted into the loops, preferably extends in each case alternately through a loop of the fastening belt and a loop of the side part.

The strip-shaped connecting element may preferably be formed as a plastic strip which can be bent at its end and which can be closed and/or fastened to the side part or to the fastening belt for example by means of a hook-and-loop fastener.

The row of loops of the fastening belt may be designed as a MOLLE system.

It is advantageous for the fastening belt to be formed by two side flank parts which, in the front area of a torso of the wearer, preferably in the region of the abdomen, can be connected directly or indirectly to one another and/or to a front part of the carrier system. It is particularly expedient if the front part of the carrier system has a hook-and-loop fastener and the fastening belt can be attached by means of the hook-and-loop fastener in the region of the front part of the carrier. The fastening belt can therefore be composed of two side flanks which are attached in each case at one end to the back part and at the other end to the front part of the carrier system, preferably by means of the hook-and-loop fastener. Here, it may also be provided that the two side flanks are connected to one another preferably by means of a hook-and-loop fastener.

It is advantageous for the shoulder strap to have, at an end facing towards the back plate, a strap part which can be releasably connected to the shoulder strap and which has the at least one fastening loop for connecting to the back plate. Said embodiment has the advantage that the belt part which is connected by means of the fastening loop and the elongate fixing element to the receptacle in the back plate (or more generally on the back part) can remain there even if the shoulder strap is to be released. This may be advantageous for the insertion of a shoulder strap adapted to the wearer of the carrier system.

It is advantageous for the hip belt to have a quick-action fastener for opening and closing. A particularly suitable quick-action fastener for this purpose is used for example in safety belts in aircraft. The quick-action fastener of the hip belt, which is arranged preferably in the front region of a human torso, preferably centrally, has the advantage that the hip belt can be released quickly if required. That is to say, to discard the entire carrier system, it may particularly advantageously suffice to release the hip belt and pull the elongate fixing element (preferably the pintle wire). The entire carrier system, including the back and front parts, thereby falls from the torso of the wearer.

It is advantageous for the support to be designed as a lateral support and to be able to be connected to the carrier strip of the back part.

The lateral support is preferably fastened to a side part or to the side of the hip belt. Here, the side part may be reinforced, for example by means of a steel or ceramic plate or an aramide insert. Here "lateral" is to be understood to mean that the lateral support takes place to the left and/or right of the body of a person when the carrier system is being worn by a person in the intended way.

The lateral support may basically be fastened to any point of the back part including the further modules attached to the back part, which in this case are to be regarded as part of the back part. The inventor has however recognized that an arrangement of the lateral support directly on the base element of the back part, preferably on the back plate, in particular on the carrier strip (which may also be formed in one piece with the back plate), is particularly suitable. Firstly, this results in a particularly stable connection and good support on the hip belt, as a result of which the loads to be carried can be absorbed particularly effectively. Secondly, it is possible in this way for rear partial sections of the carrier system, for example a rucksack which can be attached to the back part and/or a so-called electronic back, that is to say a housing provided with electronic components, to be discarded without the need to also release the hip belt. Only when the complete carrier system is to be removed is the hip belt also released.

It is also advantageous if the lateral support can be attached to the carrier strip with continuously variable or grid-based vertical adjustability. As a result of the fact that the lateral support can be fastened to the back part or the carrier strip in a continuously variable or grid-based manner, the carrier system can be quickly and easily adjusted for persons of different size.

The connection of the lateral support to the carrier strip may take place for example by means of screwing, clamping or a snap-action connection or by means of other positively locking or non-positively locking connecting elements.

It is advantageous if the lateral support can be connected to the carrier strip by means of a tongue and groove connection. Such a connection has proven to be particularly suitable, in particular for permitting continuously variable adjustment in the vertical direction.

It is also advantageous for the lateral support to comprise a damping element.

The damping element may for example be designed as a spring element or may comprise a spring element or an elastic element. The inventor has recognized that the design of the lateral support with a damping element is particularly well suited to cushioning the loads to be carried.

It is advantageous for the lateral support to comprise a rod-tube combination such that the relative movement generated by a person between the hip and torso while walking leads to a relative movement of the rod in the tube, the rod-tube combination being designed such that a movement of the rod in the tube generates an electrical current. In this regard, reference is made to the solution known from EP 1 994 841 B1. For the carrier system according to the invention, it is however self-evidently not necessary for the lateral support to have a rod-tube combination which is used for generating current. The rod-tube combination may also act merely as a damper, if appropriate with the additional use of a spring element. An embodiment for current generation is however preferably expedient if the carrier system has a housing provided with electronic components, the so-called "electronic back". The energy generated may however also be used for other electrical units and components, for example an aeration device.

It is advantageous for the lateral support to be pivotably arranged on the back part and on the hip belt via in each case two axles. It has proven to be particularly expedient for the connection of the lateral support to the back part to be realized by means of two hinges, wherein the rotary axles are preferably at right angles to one another. Furthermore, it has proven to be particularly expedient for the connection of the lateral support to the hip belt to be realized by virtue of the pivoting movement taking place about one axle by means of a hinge. The pivoting about the other axle, which is preferably at right angles thereto, may preferably be realized by virtue of the lateral support having a plate with a bore, and it being possible for said bore to be pushed or plugged onto a bolt-like axle, such that the plate with the bore extends substantially radially with respect to the bolt axis, and the plate can therefore rotate about the bolt axis.

An embodiment of the lateral support with in each case two rotary axles at the end thereof has proven to be particularly robust, and ensures advantageous freedom of movement for the person wearing the carrier system. It is advantageous for the back part to have coupling members for the coupling of a housing, in the interior space of which electronic components are arranged, or of a frame for carrying loads.

An advantageous modular design is obtained in that both a housing (or a so-called "electronic back") and also alternatively a frame for carrying loads can be coupled to the back part via coupling members.

It is particularly advantageous for the housing, in the interior space of which electronic components and/or electronic units can be arranged, to be connected in a positively locking manner directly to the back part. This results in a particularly stable and in particular also twist-resistant connection. It is also advantageous for the housing, on its end facing away from the back part, to have coupling members for the coupling of the frame for carrying loads. In this case, too, a positively locking direct connection is preferably provided between the frame and the rear side of the housing. It is advantageous here for the housing to have coupling members which correspond to the coupling members on the rear side of the back part. In this way, it is possible for the frame to be coupled either to the rear side of the housing or to the rear side of the back part.

It is advantageous for the coupling members to be formed as pockets or receiving openings and for the housing or the frame to have projections, teeth or the like which engage in an at least approximately positively locking manner into the pockets or receiving openings. It is advantageous here for the coupling elements to run in the region of the side edges on the rear side of the back part or in the region of the side edges of the rear side of the housing. Here, the pockets or the receptacles preferably extend in a preferably vertically running line on the vertically running side edges of the rear side of the back part or of the rear side of the housing.

It is advantageous for the projections or teeth which are provided for engaging into the pockets or receiving openings to be bevelled or chamfered or to have some other mechanical insertion aid or insertion aid realized by the shape of the projections or teeth. This is particularly advantageous for permitting a fast and uncomplicated connection of the individual modules in practice.

It is advantageous for at least one side wall of the housing which is intended to accommodate the electronic units and/or components to be composed of a first, preferably strip-shaped, and a second, preferably likewise strip-shaped, side part, the side wall having passage openings for plugs and the like, and the passage openings being formed at least partially by the assembly of the two side parts.

By virtue of the fact that the passage openings are formed by the connection or assembly of the first side part with the second side part, it is possible to enlarge the passage openings, in order to pass through a particularly large plug or to exchange electronic components, by releasing the two side parts from one another. After the leadthrough of the plug or the exchange of the components, the two side parts can be screwed to one another again.

In one embodiment of the invention, it may also be provided that the frame has lashing lugs, hooks, apertures or the like in order in particular to enable loads to be arranged on the frame in a simple manner. The loads may be for example one or more rucksacks and/or packing vessels.

It may be advantageous for the frame to have a baggage support. Here, the baggage support may preferably extend substantially horizontally. Loads can advantageously be seated on the baggage support.

It may be provided according to the invention that the housing and/or the frame is formed from plastic, for example from polyamide, and is if appropriate provided with corresponding reinforcement inserts.

It is particularly advantageous for the frame for carrying loads to have receiving slots, wherein a packing vessel, preferably a rucksack, is provided with loops which can be inserted into the receiving slots, wherein an elongate fixing element, preferably a pintle wire, can be passed through those ends of the loops which have been inserted into the receiving slots, whereby the loops, after the elongate fixing element has been passed through, can no longer be removed from the receiving slots. This permits a particularly advantageous connection of a packing vessel, in particular a rucksack. It may be provided here that the packing vessel or the rucksack is fastened by means of the loops and the elongate fixing elements in receiving slots on all four sides of the frame. It may however also be provided that the rucksack is fastened only to two vertically running side edges of the frame at the receiving slots provided there.

It may be provided according to the invention that, if required, the elongate fixing element, preferably the pintle wire, is pulled out again from those ends of the loops which have been inserted into the receiving slots, such that the loops can fall out of the receiving slots, as a result of which the packing vessel or the rucksack is released from the frame. The packing vessel or the rucksack can thereby be quickly and easily discarded if required by correspondingly pulling on the pintle wire. For this purpose, the pintle wire may be provided with an operating element or a handle (similarly to the embodiment already described).

It is advantageous if the housing or the frame can be locked to the back part or the frame can be locked to the housing by means of one or more locking elements or locks, wherein a closure member of the locking element can be released by means of a remote release device. The locking elements may be of self-closing design, such that after the docking of the housing or frame on the back part or the docking of the frame on the housing, locking takes place automatically. The locking elements may be for example so-called snap-action locks. The remote release device, preferably a cable pull, can actuate the closure member for example under tension or compression, so as to open the locking element. In this way, it is possible if required for the housing or the frame to be separated quickly from the frame or from the back part, or for the frame to be separated quickly from the housing, depending on how these are arranged. The person wearing the carrier system can therefore, in an emergency, discard the housing or the housing or the frame from the back part, or can discard the frame from the housing. This constitutes an alternative to, or is supplementary to, the possibility of entirely or partially discarding the carrier system by pulling out the elongate fixing element.

As a result of the release of the elongate fixing elements which connect the shoulder strap(s) and one or both ends of the fastening belt, the entire carrier system is discarded, and this possibly also results in the ballistic protection being lost. In contrast to this, by releasing the locking element, it is possible to discard only the rucksack and/or if appropriate also the electronic back (if appropriate including rucksack), whereby the ballistic protection is maintained.

It is advantageous if, for the connection of the housing or of the frame to the back part or of the frame to the housing, in each case only one locking element is provided per vertically running side edge. Here, the locking element is preferably attached to the side or side edge of the housing or of the frame and/or of the back part centrally, or in the top third, in the vertical direction.

It is advantageous if a ballistic fixture, preferably a ballistic plate, is arranged on an outer side, which faces towards a human back, of the back plate. The ballistic plate is preferably a hard ballistic plate composed of a known material, for example an SK4 plate.

Also alternatively suitable is a soft ballistic design of the front part and/or of the back part. The use of so-called composite material is also particularly suitable.

It is advantageous if the back plate is provided or clad with a textile, wherein the textile may preferably be printed with a camouflage pattern. The textile may for example be adhesively bonded and/or sewn to the back plate. The textile which clads the back plate or the back part may be designed so as to have a slot or a pocket for a hard ballistic or soft ballistic insert, in particular the ballistic plate. Here, the ballistic plate may be permanently integrated, or merely inserted when required and removed again. The ballistic plate may also be adhesively bonded to the outer side, which faces towards the human back, of the back plate. The hard ballistic plate may be of rigid, projectile-inhibiting design. The plate may be formed from ceramic, preferably from a high-performance ceramic, polymers, polyethylene, metal or a combination of the above materials. Boron carbide is also particularly suitable for this purpose.

The hard ballistic plates, in particular in an embodiment as an SK4 plate, may have a thickness of for example 1 to 3 cm, preferably of 1.5 cm.

In one embodiment of the invention, it may be provided that those parts of the carrier system which are adjacent to a human body are provided at least in regions with aeration ducts, through which air can be pumped or sucked preferably by means of a fan. Such ducts are known from EP 2 016 843 A1. To generate the air flow (mechanically or electrically), the rod-tube combination can be used.

Unless explicitly stated otherwise, within the context of the invention, the features top, bottom, side, rear or front are to be understood in relation to an alignment or arrangement which assumes that the carrier system according to the invention is being worn correctly by a person, as illustrated in the exemplary embodiments.

Below, in the exemplary embodiment on the basis of FIGS. 1 to 19, an embodiment of the solution according to the invention is illustrated which has two lateral supports. Furthermore, the carrier system according to the invention is illustrated on the basis of an embodiment of the first fastening means as fastening loops and of the second fastening means as receptacles with slots. The exemplary embodiment should however be understood to mean that, instead of two lateral supports, a first embodiment as already described above can be used in which a support is formed on the rear side of the hip belt and runs up the back along a human spine. Furthermore, it is also possible for the first fastening means to be formed as receptacles with slots and for the second fastening means to be formed as fastening loops.

Advantageous embodiments and refinements of the invention will emerge from the further dependent claims. Exemplary embodiments of the invention will be described in principle below on the basis of the drawing.

BRIEF DESCRIPTION OF THE DRAWINGS

FIGS. 1 to 4 show a diagrammatic illustration of the carrier system according to the invention with a front part 1 and a back part 2. Here, the front part 1 and the back part 2 are of ballistic, that is to say projectile-resistant or projectile-inhibiting, design. The carrier system according to the invention also has means 3, 4 for fastening the carrier system to a human torso. Here, the means are two shoulder straps 3 which run over the shoulders of a human torso and connect the front part 1 to the back part 2. The means for fastening to a human torso are also a fastening belt 4 which runs above a human hip.

The fastening belt 4 is realized by two side flanks connected in each case at one end to the back part 2. Here, the side flanks are passed around the side of a human torso to the front side thereof, and are connected there in a positively locking or non-positively locking manner such that the fastening belt 4 helps to stabilize the carrier system. It is provided in the exemplary embodiment that the ends of the side flanks of the fastening belt 4 are fastened, in the region of a human torso, either to one another or to the front part 1. It is provided in the exemplary embodiment that the ends are fastened to a hook-and-loop fastener 101 of the front part 1. Here, it may also be provided that the ends of the side flanks of the fastening belt 4 overlap. It is however advantageous if the ends do not overlap, such that a uniform surface is formed.

Figure 3:
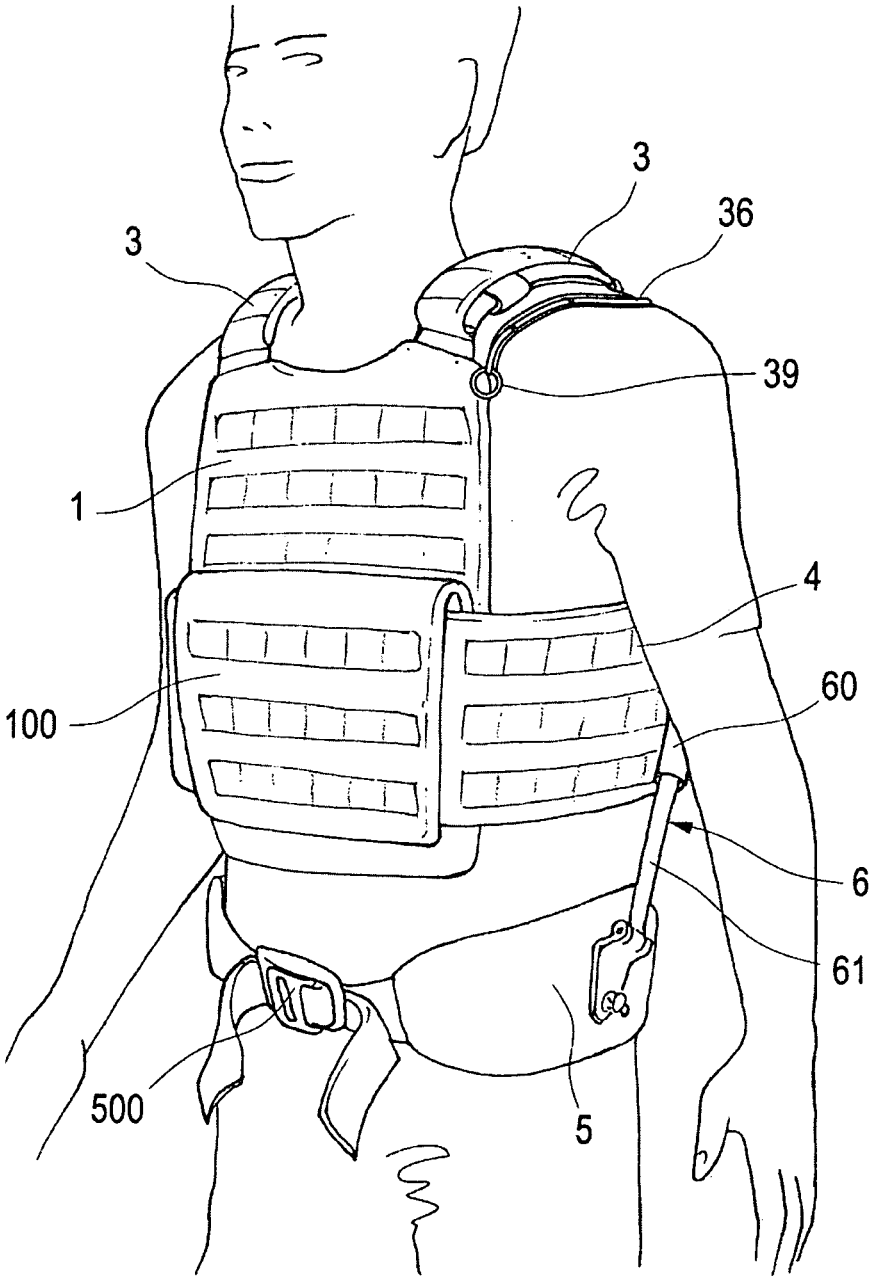
FIG. 3 shows a perspective illustration, from the front, of the carrier system according to the invention.
Figure 4:
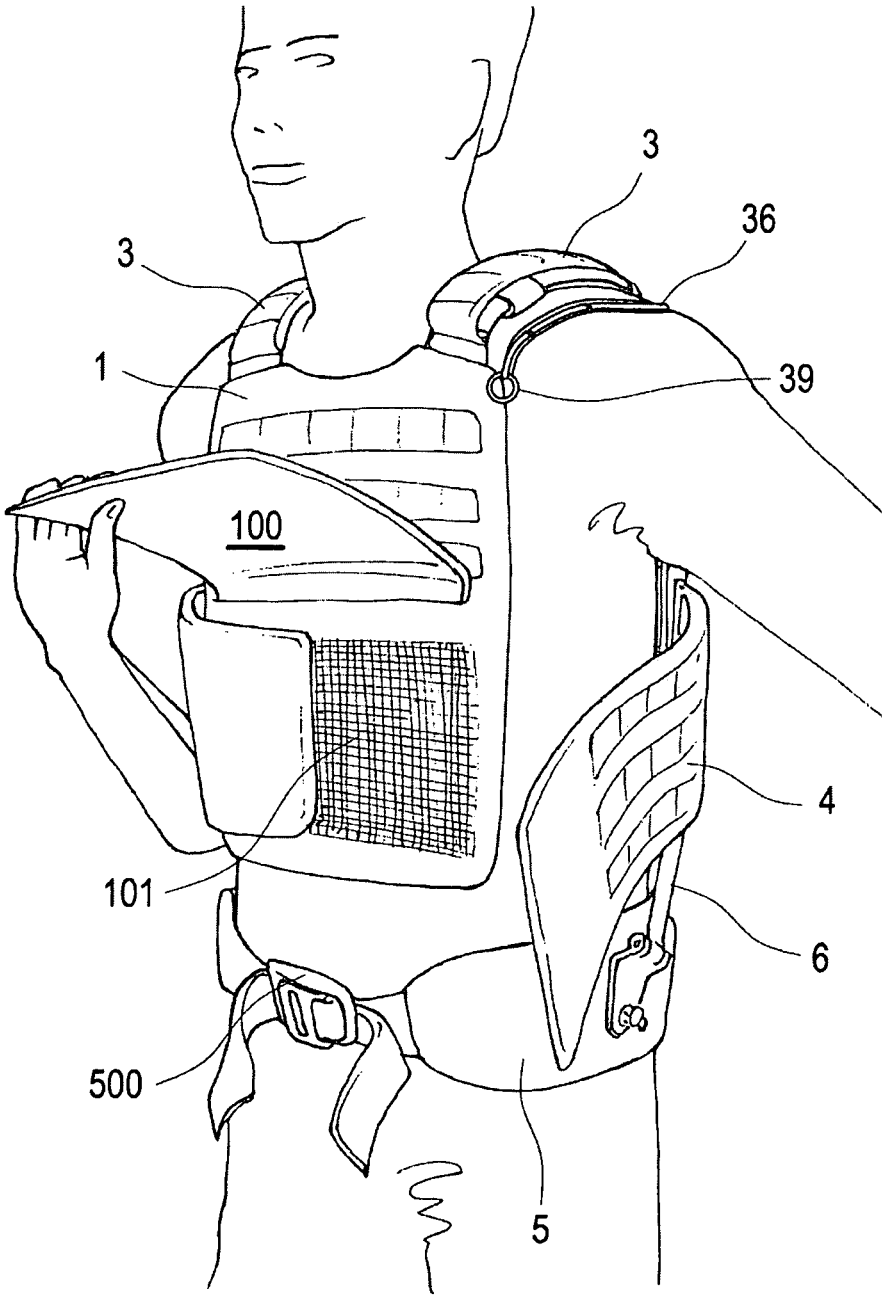
FIG. 4 shows an illustration according to FIG. 3, with a flap of the front part open.

FIGS. 3 and 4 illustrate a particularly advantageous option for connecting together the two ends, which face away from the back part 2, of the side flanks. For this purpose, the front part 1 has a flap 100 under which the hook-and-loop fastener 101 is concealed. To connect the side flanks, the flap 100 can be pivoted open or raised such that the ends of the side flanks can be attached to the hook-and-loop fastener 101. After the attachment of the ends of the side flanks, the flap 100 is closed again.

The fastening belt 4 or the side flanks thereof may be of ballistic design, or provided with ballistic inserts, in particular in the regions in which they bear directly against a human torso.

The carrier system according to the invention also has a hip belt 5. Two lateral supports 6 are provided on or attached to the hip belt 5. Here, the lateral supports 6 are arranged on the side parts of the hip belt 5. Here, "side part" or "lateral" is to be understood to mean that the lateral supports 6 are situated to the left and right of the body of a person when the carrier system according to the invention is worn correctly.

The lateral supports 6 are fastened with one end to the hip belt 5 and with the other end to the back part 2.

It is advantageous for the fastening belt 4 to have a quick-action fastener 500 for opening and closing. In this way, the hip belt 5 can be quickly opened and discarded if required (see FIG. 1).

The hip belt 5 may be of ballistic design or provided with ballistic inserts. In the exemplary embodiment, no ballistic design or insert is provided.

Figure 1:
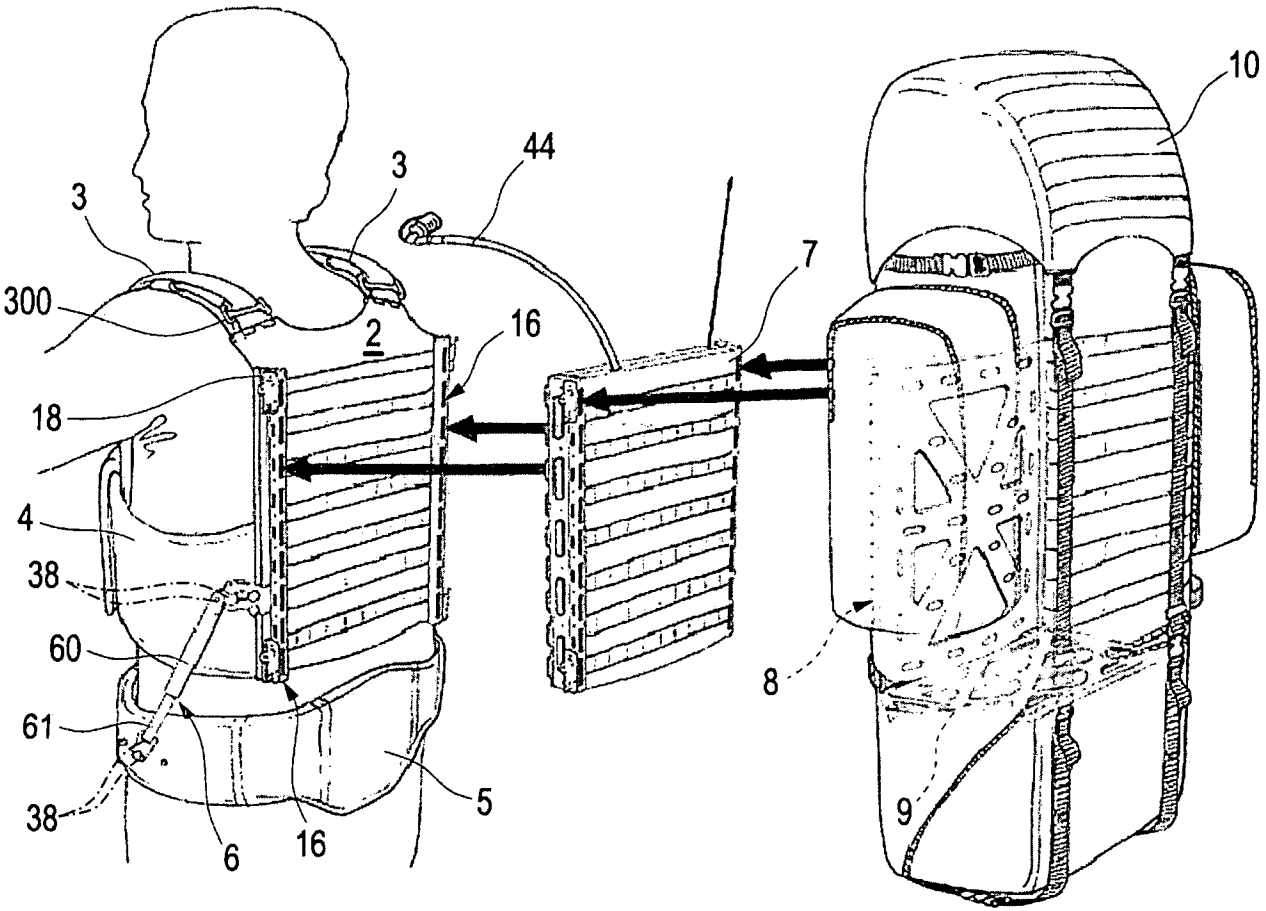
FIG. 1 shows a perspective illustration of the carrier system according to the invention from the rear in an exploded illustration, said carrier system having a front part, a back part, a hip belt, a fastening belt, a housing for accommodating electronic components, a frame for carrying loads, and a rucksack.
Figure 2:
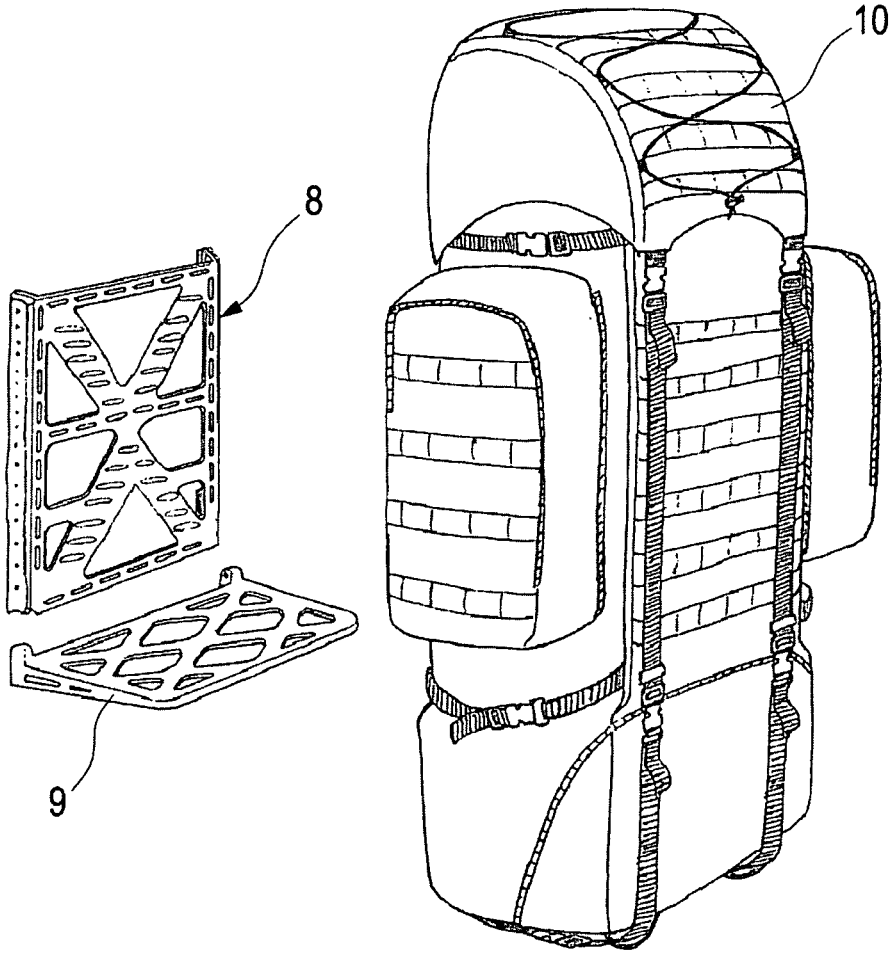
FIG. 2 shows a detail illustration of the frame and of the rucksack according to FIG. 1.
Figure 5:
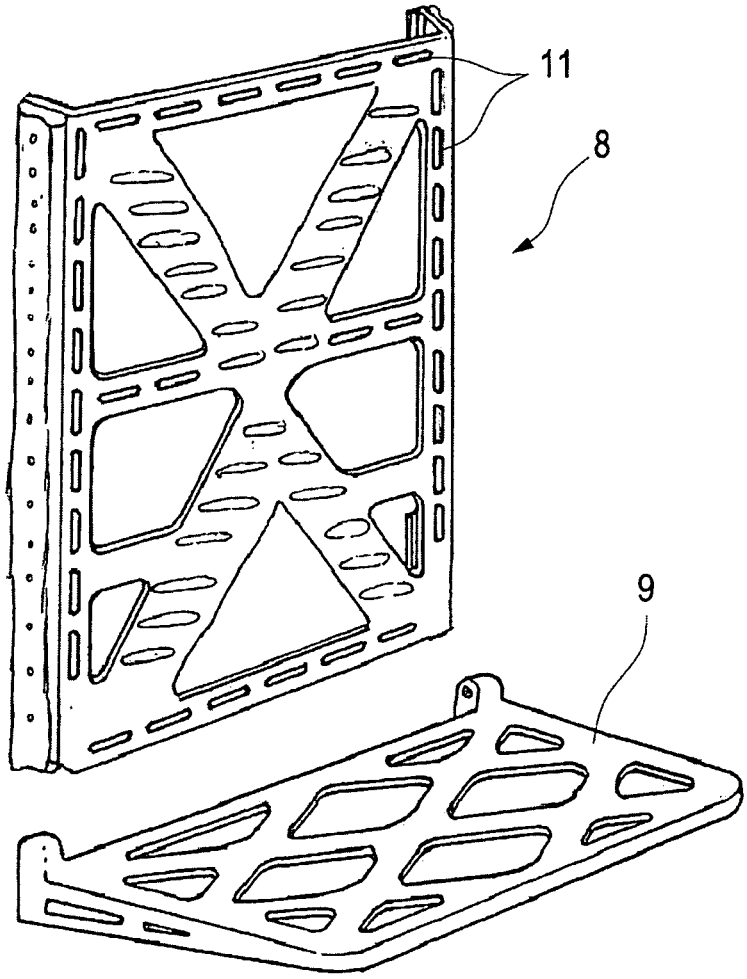
FIG. 5 shows a detail illustration of a frame for carrying loads, with a baggage support.

As also emerges from FIG. 1 and FIG. 2, the carrier system according to the invention has a housing 7 for accommodating electronic components and/or electronic units, which housing can be connected to the back part 2, in the exemplary embodiment in a positively locking manner. Furthermore, the carrier system according to the invention may comprise a frame 8 for carrying loads. Here, the frame 8 may have a baggage support 9 (not illustrated in any more detail in FIG. 5). The loads carried by the frame 8 may be for example packing bags, preferably a rucksack 10 illustrated in FIG. 3 and FIG. 4. Here, the rucksack 10 may be designed so as to have, in the lower third, a slot or a pocket into which the baggage support 9 can be inserted in order to stabilize the rucksack 10. This can be seen particularly clearly from FIG. 1 and a juxtaposition of FIG. 2 or 5 (which shows the baggage support 9) with FIG. 18, in which the baggage support 9 is no longer visible because it has been inserted into a corresponding slot of the rucksack 10.

Figure 6:
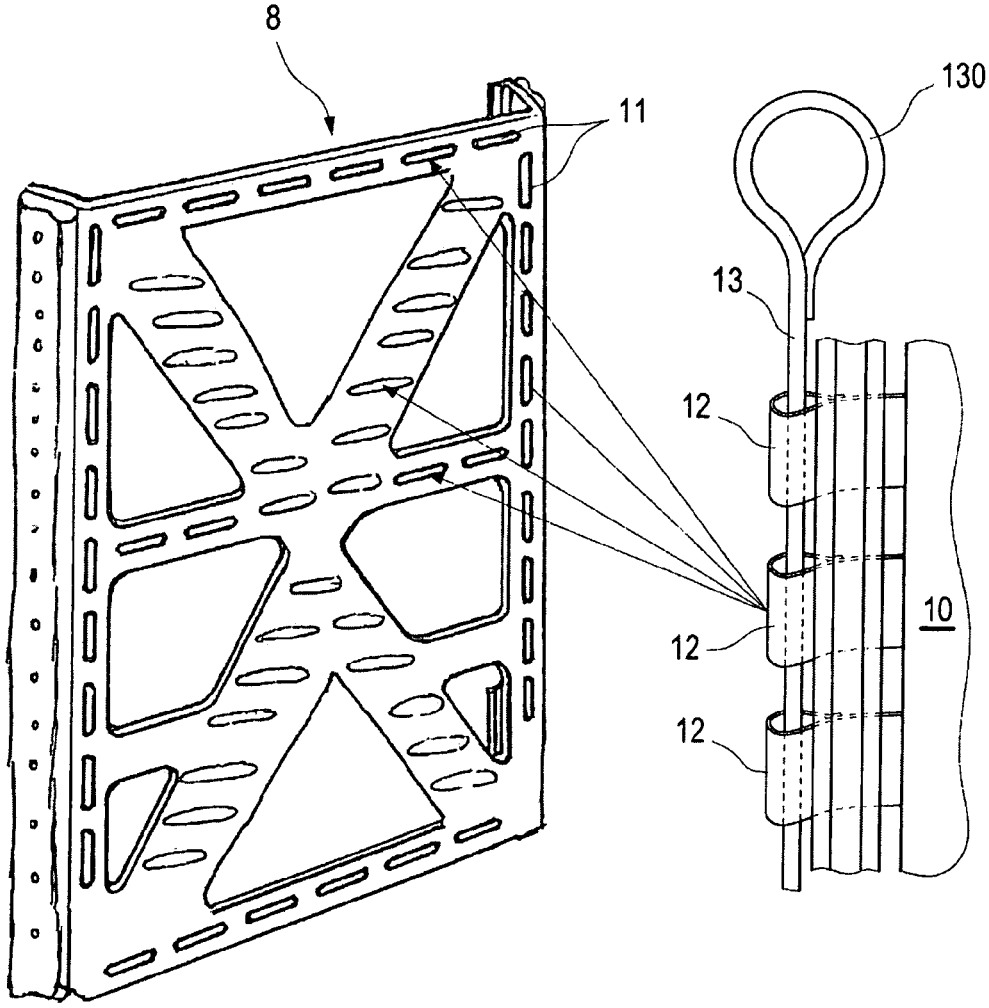
FIG. 6 shows a diagrammatic illustration of a connection of a rucksack to a frame for carrying loads.

FIG. 6 shows a particularly suitable facility for attaching, in particular releasably fastening, the rucksack 10 to the frame 8. For this purpose, the frame 8 for carrying loads has receiving slots 11. The rucksack 10 has loops 12 which can be inserted into the receiving slots 11. After the insertion of the loops 12 into the receiving slots 11, an elongate fixing element 13 is passed through those ends of the loops 12 which have been inserted into the receiving slots 11 (see detail image at the right of FIG. 6). After the elongate fixing element 13 has been passed through, the loops 12 can no longer be removed from the receiving slots 11. Only when the elongate fixing element 13 is pulled out of the loops 12 do the loops 12 fall out of the receiving slots 11 again, in particular on account of the weight of the rucksack 10, such that the rucksack 10 is automatically discarded.

The means, referred to generally as an elongate fixing element 13, for fixing the loops 12 in the receiving slots 11 may be designed preferably as a cable, a wire or some other elongate fabric, composed in particular of plastic or metal, preferably steel. Below, the elongate fixing element is referred to as a pintle wire 13, but the invention is self-evidently not restricted to this. The features described within the context of the invention can also be realized in conjunction with other embodiments of the elongate fixing element, and should also be regarded as being disclosed in this respect.

The connection of the rucksack 10 as illustrated in principle in FIG. 6 may take place by means of individual receiving slots 11 distributed along the circumference of the frame 8 or may also take place in an a really distributed manner, for example in a manner distributed over the frame 8 in a loop configuration. It is preferable for the rucksack 10 to be fixed to all four side edges of the frame 8 by means of at least two receiving slots 11.

The rucksack 10 may have a known MOLLE system or loop system for connecting further packing bags, skis or the like.

Figure 7:
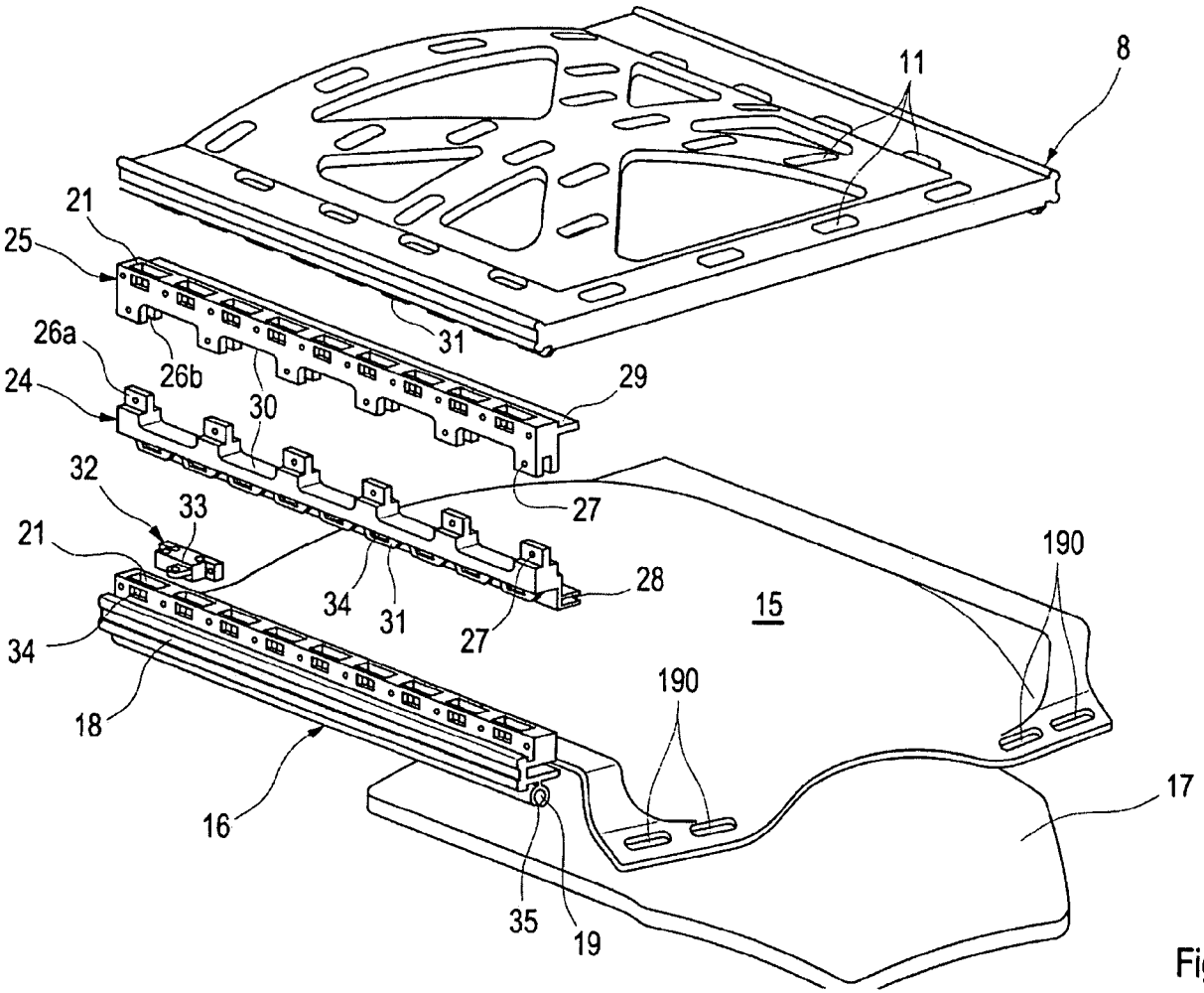
FIG. 7 shows an exploded illustration of the back part of the carrier system, showing a ballistic plate, a back plate, a carrier strip, two strip-like side parts of a housing—not showing a base plate and a rear cover of the housing—and a frame for carrying loads.
Figure 8:
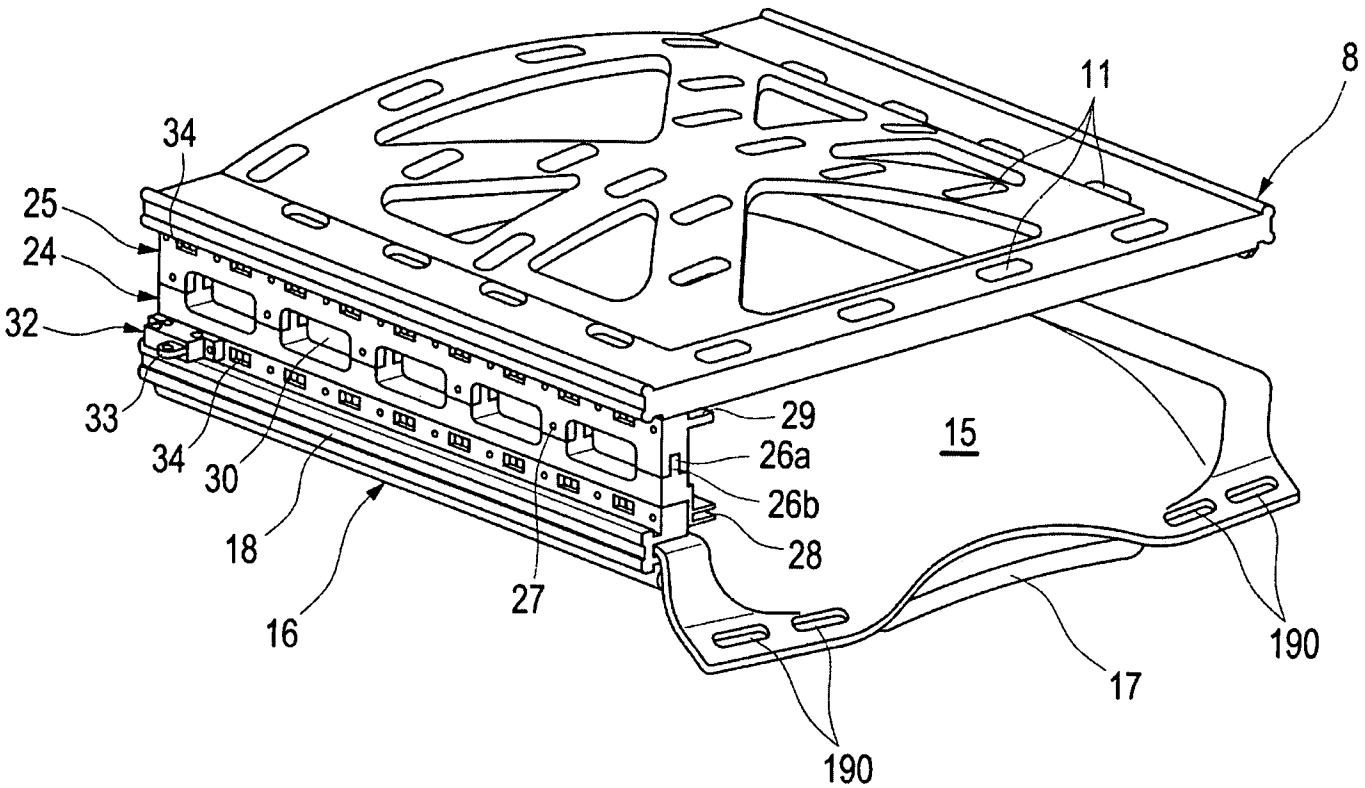
FIG. 8 shows an illustration according to FIG. 7 in the assembled state, with only the side parts and the carrier strip on one side edge of the back plate being shown.
Figure 9:
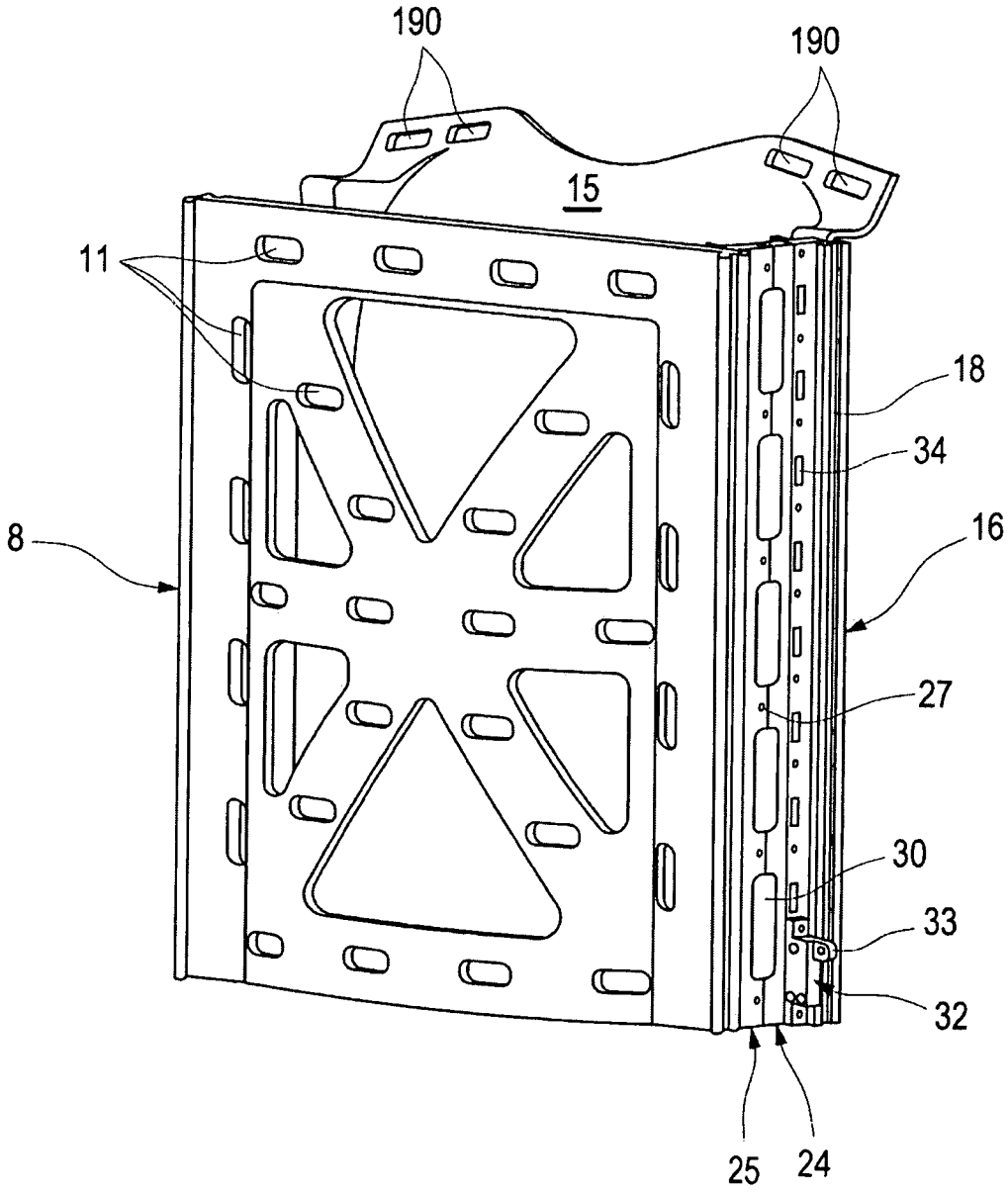
FIG. 9 shows a view from the rear of the components illustrated in FIG. 8 in an alignment in which they are carried when worn, with correct use, on a human torso.
Figure 10:
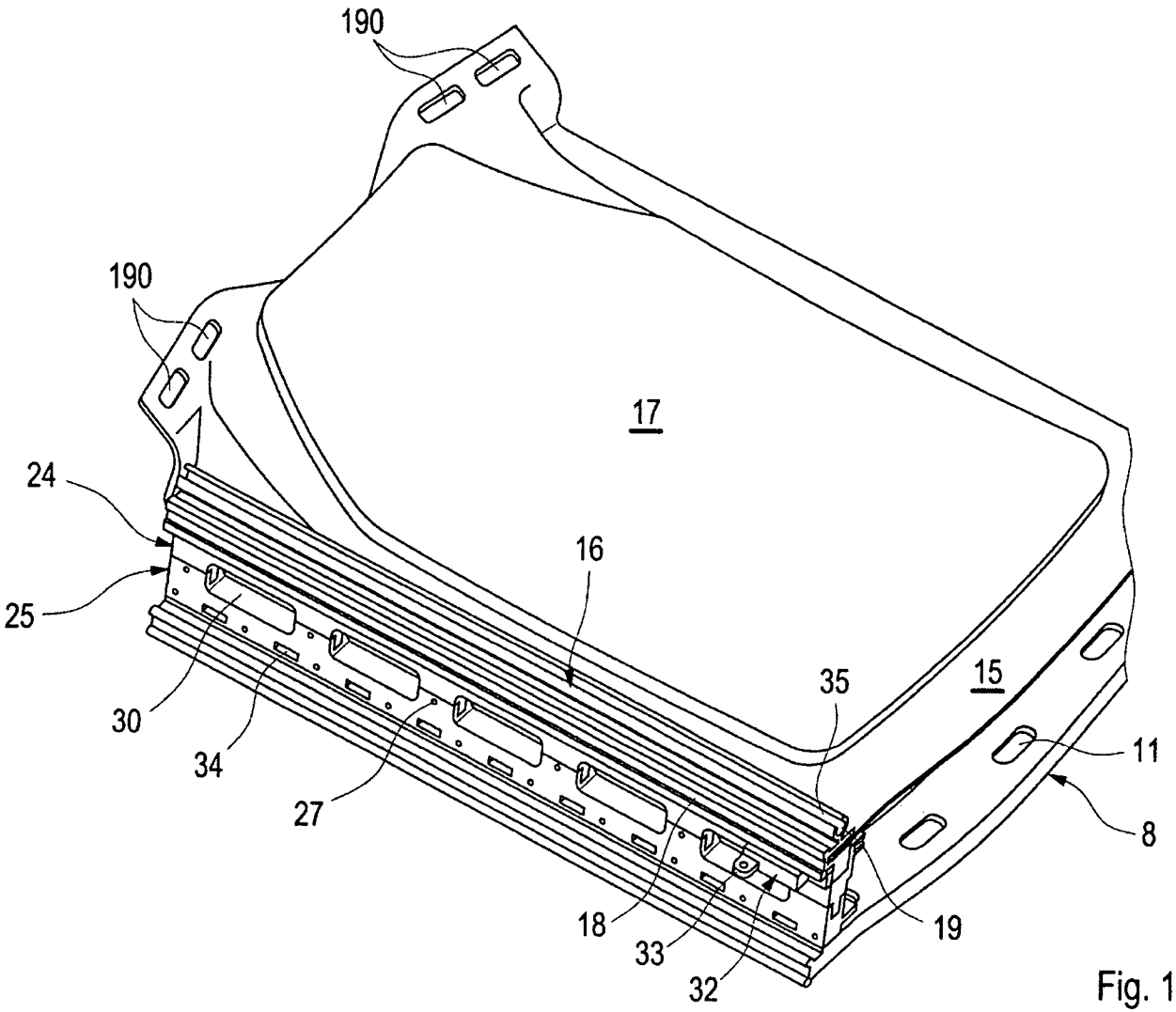
FIG. 10 shows an illustration according to FIG. 9 from the front.

FIG. 7 shows an exploded illustration of the back part 2 which, in the illustrated embodiment, comprises a back plate 15 and two carrier strips 16 (only one carrier strip is illustrated in FIG. 7). FIGS. 7 to 13 show an embodiment in which it is provided that the back part 2 is assembled from a back plate 15 and two carrier strips 16 which are formed separately therefrom and which can be attached to vertically running side edges of the back plate 15. The back plate 15 may however likewise already be formed integrally or in one piece with a corresponding carrier strip 16. The back plate 15 is clad or provided, in a way not illustrated in any more detail, with a textile, the textile preferably having a pocket or a slot. A ballistic plate 17 can be arranged in or inserted into the pocket or the slot. Here, the ballistic plate 17 is arranged on an outer side, which faces towards a human back, of the back plate 15. The ballistic plate 17 may also be adhesively bonded to the back plate 15. It is provided in the exemplary embodiment that the carrier strip 16 is pushed or plugged on only after the back plate 15 has been clad with the textile. The carrier strips 16 can be plugged in a positively locking manner onto the textile-clad side edges of the back plate 15 and preferably further secured there by means of a screw connection and/or adhesive bond.

It is provided in the exemplary embodiment that the carrier strip 16 has both a rail 18 for the connection of a lateral support 6 and also a receptacle 19 for the insertion of a fastening loop 20, described in more detail below on the basis of FIGS. 16 and 17. Furthermore, the carrier strip 16 has coupling elements 21 which serve for the coupling of the housing 7 or the frame 8.

Figure 11:
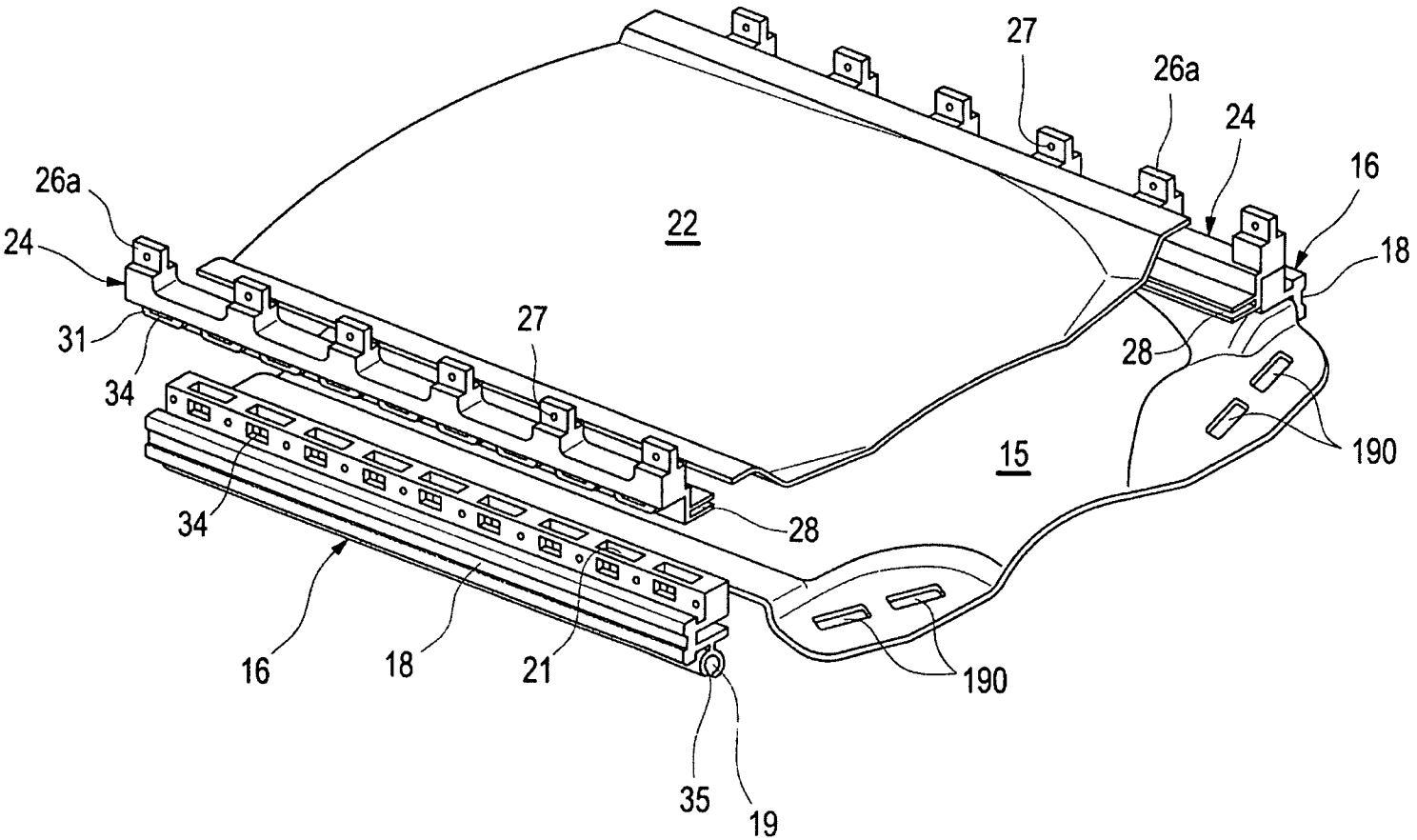
FIG. 11 shows an exploded illustration of the back part, showing a back plate, two carrier strips, a base plate for a housing for accommodating electronic components, and two first side parts of the housing, which hold the base plate.
Figure 12:
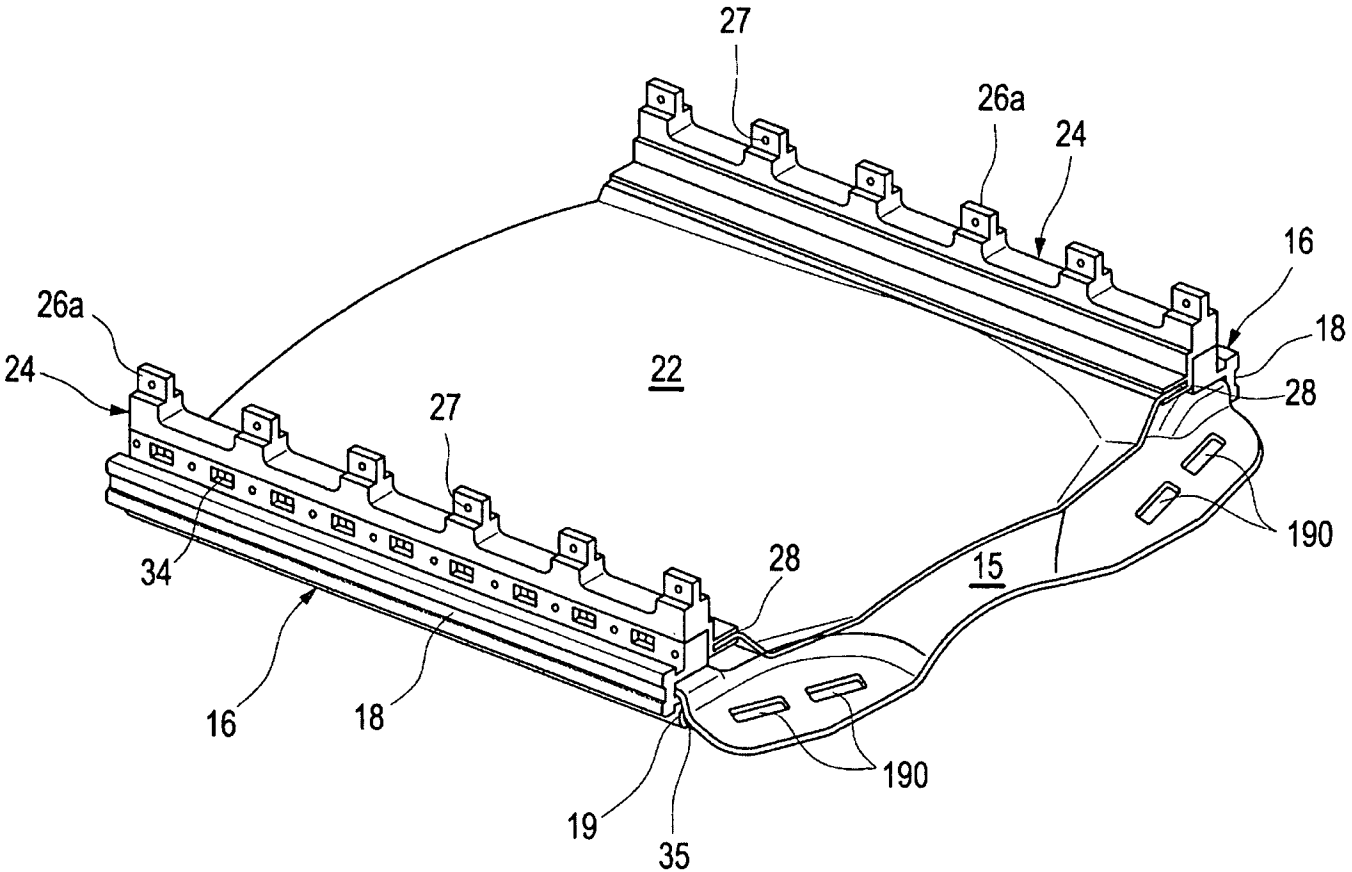
FIG. 12 shows an illustration according to FIG. 11 in the assembled state.
Figure 13:
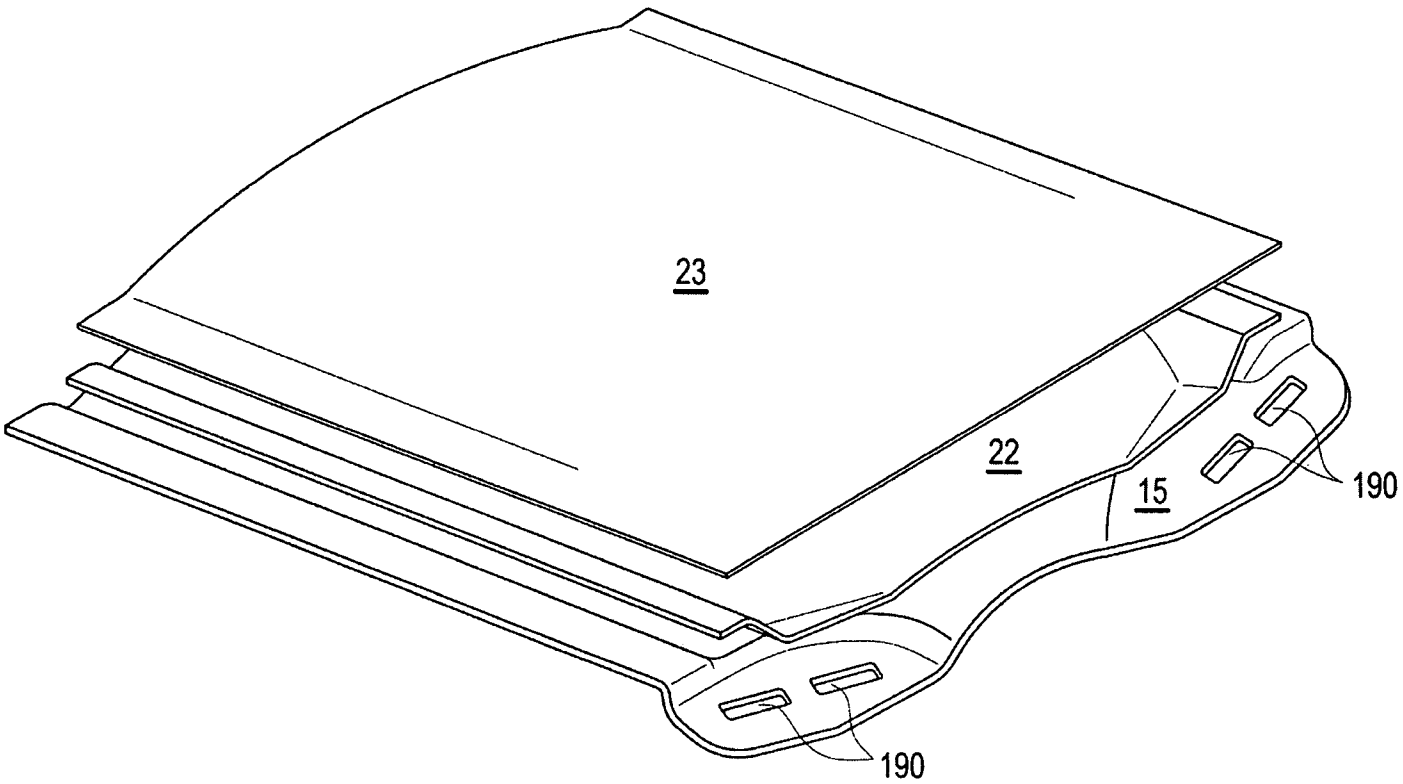
FIG. 13 shows an illustration according to FIG. 11 without the carrier strips and the side parts, but with a diagrammatic illustration of the rear cover of the housing.

FIGS. 11 to 13 show a base plate 22 of the housing 7 for accommodating the electronic components, parts or units. Here, it may be provided that the electronic components and units are fastened to the base plate 22. The base plate 22 preferably at least approximately corresponds, in terms of its dimensions and shape, to the back plate 15.

FIG. 13 shows a diagrammatic illustration of the rear cover 23 of the housing 7. Here, it is preferably provided that the cover 23 can be opened, or is preferably connected to a side edge by means of a hinge such that it can be pivoted open, so as to allow access to electronic components and parts contained in the housing 7. The cover 23 may also be arranged on the side wall of the housing 7 by means of a beading strip. This is not illustrated in any more detail in the exemplary embodiment. The side wall of the housing 7 which connects the cover 23 to the base plate 22 is illustrated in FIGS. 7, 8, 9, 10 and in part in FIG. 11 and FIG. 12. The two vertically running side walls of the housing 7 are formed in each case in two parts by a first side part 24 and a second side part 25. In the exemplary embodiment, the side parts 24, 25 are of strip-shaped design. The side parts 24 and 25 may be connected to one another or plugged together for example by means of connecting members which engage into one another in a positively locking manner, and subsequently further secured by means of a screw connection. In the exemplary embodiment, the first side part 24 has projections or springs 26*a* which correspond to grooves 26*b* of the second side part 25. Bores 27 are provided for screwing the springs 26*a* into the grooves 26*b*. The first side part 24 has a groove 28 which extends along the first side part 24 and into which the base plate 22 can be plugged. Other positively locking, non-positively locking or cohesive connections are also possible for this purpose. The second side part 25 has a support 29 on which the cover 23 (see FIG. 13) can be supported or to which said cover can be fastened. Here, too, any other desired design solutions are possible for connecting the cover 23 to the second side part 25.

The cover 23 may constitute the rear wall of the carrier system if no frame 8 is used or if no water store—described below—is used. The cover 23 is designed preferably as a step guard or designed such that, if appropriate in conjunction with the second side part 25, a person can stand or step on the cover 23 without the carrier system being damaged.

The advantage of the side wall of the housing 7 being formed by the two side parts 24, 25 is that each of the two side parts 24, 25 can form in each case one part of a passage opening 30. That is to say, the passage openings 30 present in the side walls of the housing 7 can be formed in each case entirely by virtue of the first side part 24 being connected to the second side part 25. This makes it possible, if it is necessary for large plugs to be passed through, for the side parts 24, 25 to be able to be released from one another, as a result of which the large plug can be passed through, and the side parts 24, 25 can subsequently be connected to one another again by means of a screw connection. Units can also be inserted into the interior space of the housing 7 in this way.

To connect the side wall of the housing 7, in the exemplary embodiment of the first side part 24, to the carrier strip 16, the carrier strip 16 has the abovementioned coupling elements 21. Here, a multiplicity of coupling elements 21 are provided which extend along the longitudinal axis of the carrier strip 16. The coupling elements 21, which in the exemplary embodiment are designed as pockets or as fastening openings, are engaged into preferably in an at least approximately positively locking manner by protections or teeth 31 of the first side part 24, which are of correspondingly complementary design. To insert the teeth 31 into the pockets 21 of the carrier strip 16, the teeth 31 may be bevelled or chamfered at least on a front edge.

In the exemplary embodiment, to fix the teeth 31 in the pockets 21, a locking element 32 is provided. Here, the locking element 32 comprises a closure member 33 (not illustrated in any more detail) which closes automatically when the teeth 31 are inserted into the pockets 21. It is provided here that the closure member 32 locks the teeth into the pockets with a movement at right angles to the insertion direction of the teeth 31 into the pockets 21. The pockets 21 and the teeth 31 have closure receptacles 34 into which the closure member 33 (not illustrated in any more detail) can latch. The locking element 32 may preferably be fastened laterally to the carrier strip 16, for example by means of a screw connection. It is advantageous for the carrier strip 16 to have only one locking element 32. It is also advantageous (not illustrated) if the closure member 33 can, when required, be influenced by remote unlocking means such that the closure member 33 opens, as a result of which the first side part 24 falls from the carrier strip 16.

It is advantageous if in each case one carrier strip 16 is provided on both sides of the back plate 15 and the two carrier strips 16 are connected in each case to a side part 24 by being plugged in.

In a way which is not illustrated in any more detail, it is also possible for the frame 8 to be fastened directly to the carrier strips 16. For this purpose, the frame 8 may have corresponding teeth 31 (not illustrated) which engage analogously into the pockets 21 and are held there preferably by the locking element 32. The teeth 31 may be formed directly on the frame 8 or on the two side parts in a vertically running manner, or on one or more strips which can be connected to the frame.

In the exemplary embodiment illustrated in FIGS. 7 to 13, it is provided that the frame 8 is fastened to the second side part 25. For this purpose, the second side part 25 has pockets 21 which may correspond to the pockets 21 of the carrier strip 16. Here, the connection of the frame 8 to the second side part 25 takes place analogously to the connection of the first side part 24 to the carrier strips 16 and may likewise be secured by means of a locking element 32 (preferably provided with a remote unlocking means). Further details regarding the carrier strip 16, the first side part 24, the second side part 25 and the frame 8 and also the back plate 15 will emerge from FIGS. 7 to 10. The components are formed preferably from plastic. A metal embodiment is however also possible here.

Figure 16:
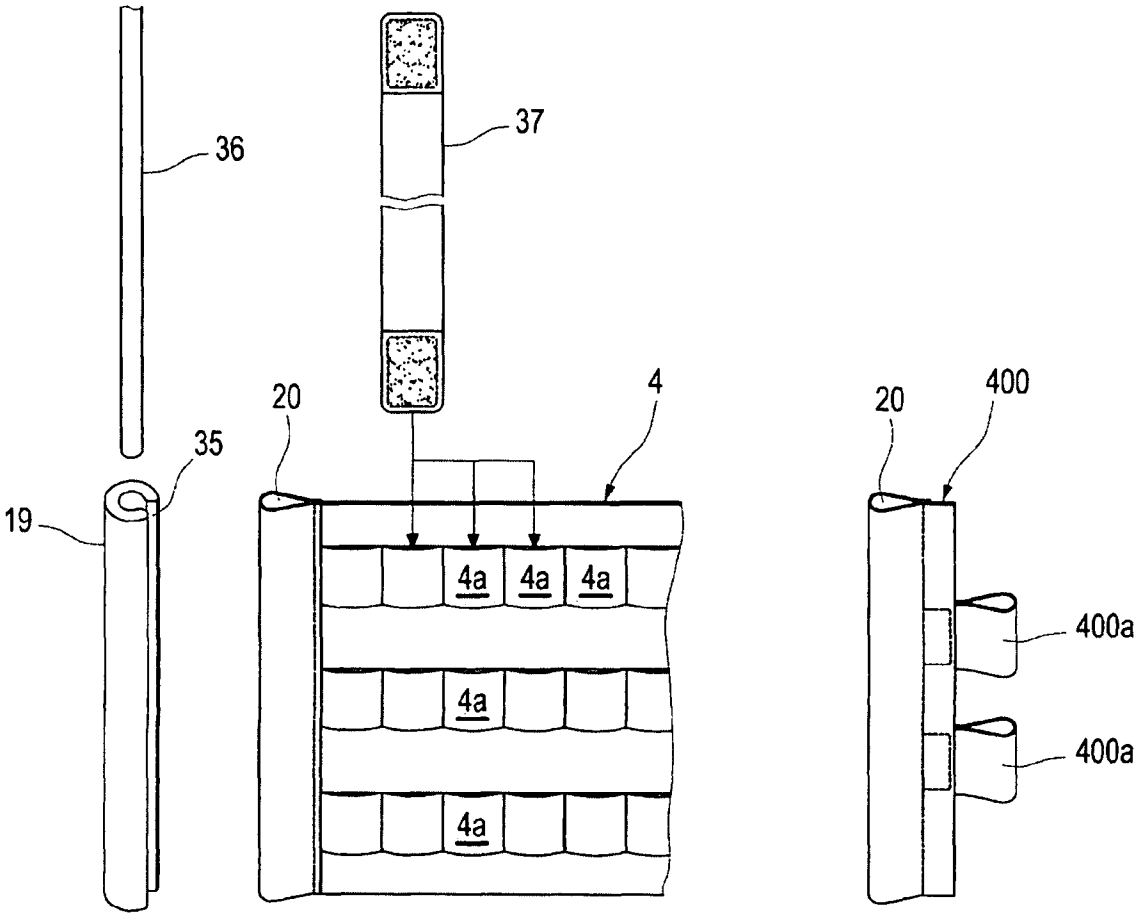
FIG. 16 shows a diagrammatic illustration of the individual parts for connecting a means for fastening to a human torso, in the present case a fastening belt, to a receptacle of the back part or of the carrier strip, diagrammatically showing the fastening loops on the fastening belt; an elongate fixing element in the form of a pintle wire; and a side part with fastening loops as an adapter piece for the fastening belt, which can be connected by means of a strip-shaped connecting element to the fastening belt.
Figure 17:
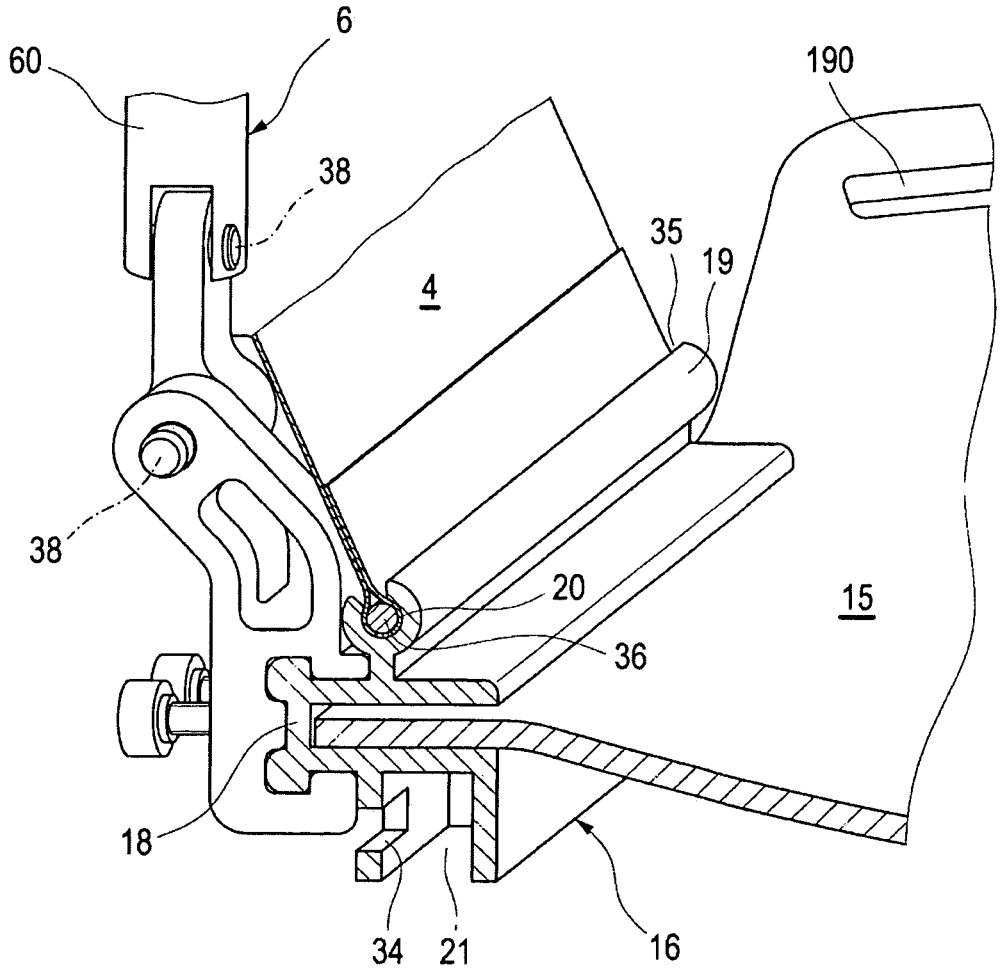
FIG. 17 shows a diagrammatic illustration of the carrier strip to which the fastening belt is connected in the manner of a beading connection, diagrammatically showing the lateral support (only partially illustrated) connected to the carrier strip.
Figure 18:
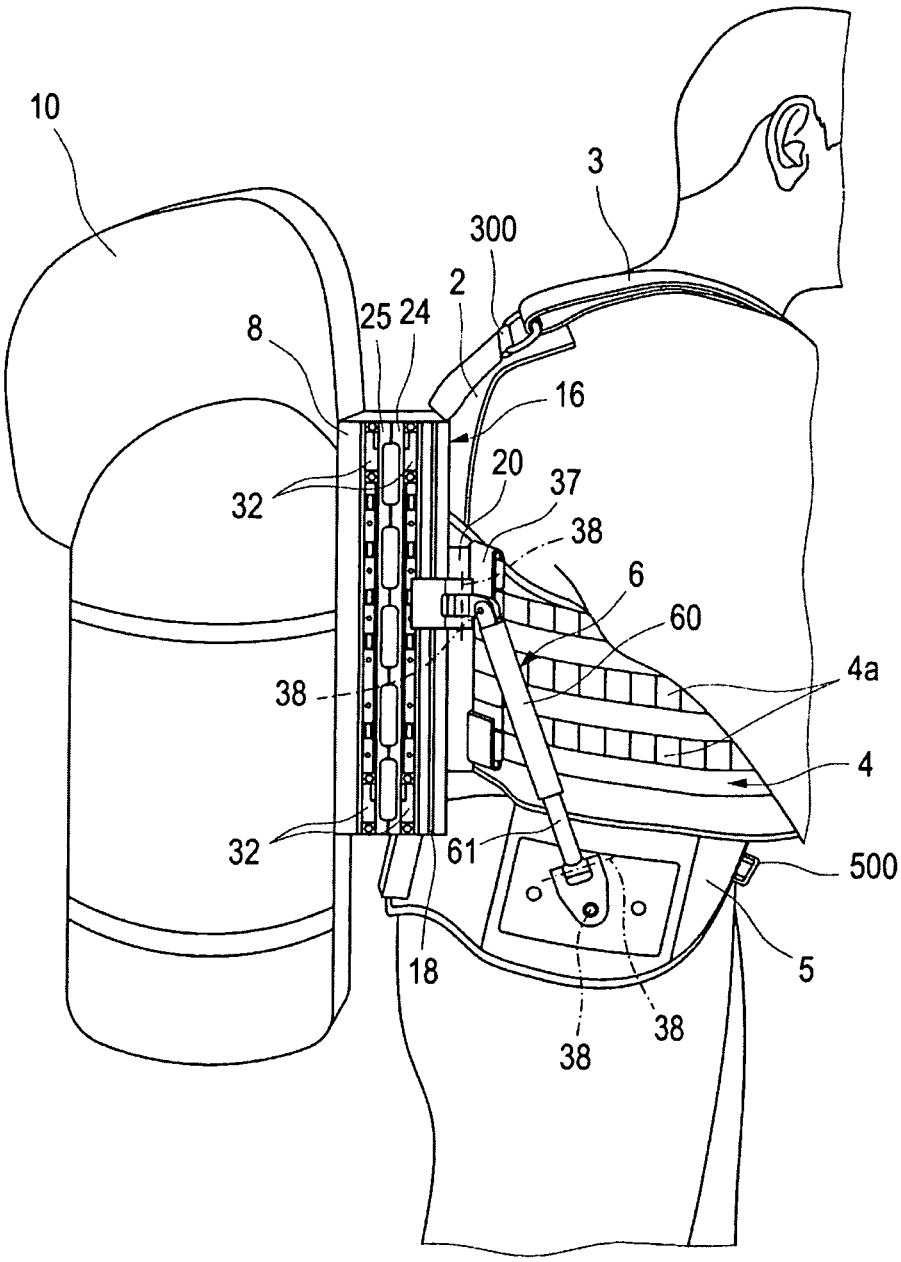
FIG. 18 shows a side view of the carrier system according to the invention, showing a hip belt and a lateral support which connects the hip belt to the back plate or the carrier strip, and having a rucksack.
Figure 19:
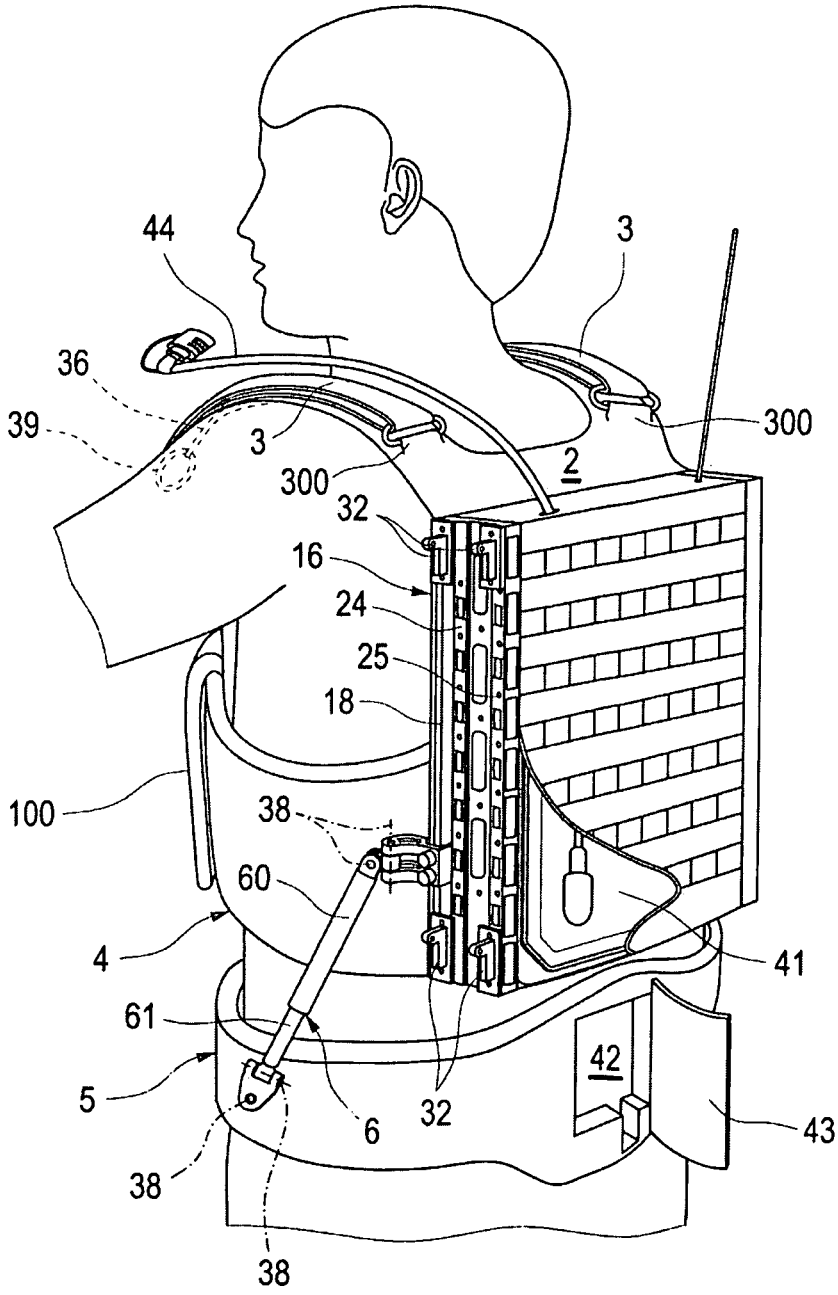
FIG. 19 shows a side view of the carrier system according to the invention as per FIG. 18, without a rucksack.

As can be seen from a juxtaposition of FIGS. 10 to 13 with FIGS. 18 and 19 and in particular the diagrammatic illustration in FIGS. 16 and 17, the carrier strip 16 (which may also be formed in one piece with the back plate 15) has a receptacle 19 for the connection of a fastening loop 20. Here, in the exemplary embodiment, the receptacle 19 is designed similarly to a beading rail or beading strip. The receptacle 19 constitutes substantially a tube with a longitudinal slot 35. The receptacle 19 has substantially a circular to oval cross section. The fastening loop 20 (see FIGS. 16 and 17) can be inserted into the receptacle 19 through the slot 35 or preferably at the face-side ends of the receptacles 19. In the exemplary embodiment, the fastening loop 20 which is inserted into the receptacle 19 is attached to the fastening belt 4 or to a side part 400 that can be connected to the fastening belt 4. By means of the fastening loop 20, the fastening belt 4 is fastened to the back part 2 or, in the exemplary embodiment, to the carrier strip 16 in that, after the fastening loop 20 has been inserted into the receptacle 19, an elongate fixing element 36, which is preferably a pintle wire, is threaded into the receptacle or through that end of the fastening loop which has been inserted into the receptacle. Here, the slot 35, the fastening loop 20 and the pintle wire 36 are designed such that the fastening loop 20, after the pintle wire 36 is passed through, can no longer pass out through the slot 35. The fastening belt 4 is thereby connected to the back part 2 or to the carrier strip 16 in a secure and stable manner.

A removal of the fastening loop 20 from the receptacle 19 takes place by virtue of the pintle wire 36 being pulled out of the fastening loop 20 or the receptacle 19 again. As a result, the fastening belt 4 falls from the carrier strip 16 and therefore from the back part 2. For connecting the fastening loop 20 to the carrier strip 16 or the back part 2, other designs of the receptacle 19 are also possible, for example designs such as that provided according to FIG. 6 with regard to the connection of the rucksack 10 to the frame 8.

It is provided in the exemplary embodiment that the fastening belt 4 or the side part 400 has one large fastening loop 20. It is however also possible here for two or more correspondingly relatively small fastening loops 20 to be provided instead of one large fastening loop (with regard to the vertical extent).

The means 36, referred to as an elongate fixing element 36, for fixing the fastening loop 20 in the receptacle 19 may be designed preferably as a cable, a wire or some other elongate fabric, in particular composed of plastic or metal, preferably steel. Below, the elongate fixing element is referred to as a pintle wire 36, but the invention is self-evidently not restricted to this. The features described within the context of the invention can also be realized in conjunction with other embodiments of the elongate fixing element, and should also be regarded as being disclosed in this respect.

It is provided in the exemplary embodiment that both side flanks of the fastening belt 4 are attached in each case to a carrier strip 16 by means of corresponding fastening loops 20 in the described way. It is however basically sufficient for one side flank of the fastening belt 4 to be correspondingly attached. Even the release of one end of a side flank of the fastening belt 4 from the associated carrier strip 16 or the back part 2 causes the back part 2 with the fastening belt 4 to be released from the torso.

As can be seen in particular from an illustration of FIGS. 16 to 19, the fastening belt 4 or the side flank thereof has, at least at an end facing towards the carrier strip 16, a side part 400 which can be releasably connected to the fastening belt 4 and which comprises the fastening loops 20 for connecting to the carrier strip 16. This can be seen particularly clearly from FIG. 16. The fastening belt 4 and the side part 400 have, for connecting to one another, in each case one row of loops 4*a* and 400*a* respectively. The loops of the row of loops 4*a* and the loops of the row of loops 400*a* are arranged here such that the loops of one row of loops can be inserted into the spacings between the loops of the other row of loops, such that a common row of loops 4*a*, 400*a* can be formed which, in the exemplary embodiment, extends substantially in the vertical direction. In the exemplary embodiment, a strip-shaped connecting element 37, preferably a plastic strip which is preferably clad with textile, is pushed through said common row of loops 4*a*, 400*a* (see in particular FIG. 16). Here, the plastic strip 37 is designed so as to be longer than the row of loops 4*a*, 400*a*, such that the protruding ends of the plastic strip 37 can be bent. The bent ends of the plastic strip 37 may preferably be closed off by a hook-and-loop connection. This yields a stable connection between the fastening belt 4 and the side part 400 of the fastening belt 4. The advantage of said design is that the side part 400 can be connected to fastening belts 4 of different length, without it being necessary for the fastening loop 20 to be released from the receptacle 19. It is particularly advantageous here for the fastening belt 4 to have a plurality of rows of loops 4*a* which run parallel to one another (see in particular FIG. 16), such that the row of loops 400*a* of the side part 400 can be connected to a suitably positioned row of loops 4*a* (see the three arrows proceeding from the plastic strip 37). In this way, the length of the fastening belt 4 or the length of the side flanks of the fastening belt 4 can be shortened or lengthened.

It is advantageous for the fastening belt 4 to have in each case one side part 400 on both of its ends or on both side flanks.

The side part 400 therefore serves as an adaptor by means of which the fastening belt 4 can be attached to the carrier strip 16. It is self-evidently also possible for the fastening belt 4 to be arranged by means of its fastening loop 20 directly on the carrier strip 16. For this purpose, FIG. 16 illustrates in principle a fastening loop 20 on the fastening belt 4. It is however preferable, and provided in the exemplary embodiment, that the fastening belt 4 is connected to the side part 400 by means of the row of loops 4*a*, 400*a*. The connection between the fastening belt 4 and the carrier strip 16 then takes place by virtue of the side part 400 being inserted with its fastening loop 20 into the receptacle 19 of the carrier strip 16. In this case, the fastening loop 20 of the fastening belt 4 does not perform any function, and could therefore also be omitted. That end of the fastening belt 4 which protrudes beyond the side part 400 may be placed or inserted loosely between the back part 2 and the back of the torso of the person wearing the carrier system.

As can also be seen from FIGS. 7 to 15, the back plate 15 has, in an upper end region, receptacles 190 which serve for releasably connecting the fastening loops 20, which are attached to the shoulder strap 3, to the back plate 15 by means of an elongate fixing element 36, preferably again a pintle wire 36. Here, the receptacles 190 are designed substantially analogously to the receiving slots 11 already described with regard to the embodiment of the frame 8 illustrated in FIG. 6. For this purpose, the fastening loops 20 are passed through the receptacles 190 and subsequently, by means of the pintle wire 36, are prevented from exiting the receptacles 190 again counter to the insertion direction. It is advantageous here for the pintle wire 36 which holds the fastening loops 20 of the shoulder strap 3 in the receptacles 190 to be identical to the pintle wire 36 which is threaded at least into a receptacle 19 of a carrier strip 16. In this way, it is possible for both the connection of the carrier strips 16 to the fastening belt 4 and also the connection between the back part 2 or the back plate 15 and the shoulder strap 3 to be released by pulling one pintle wire 36.

It is provided in the exemplary embodiment that both shoulder straps 3 are connected to the receptacles 190 by means of the fastening loops 20. It may however basically be adequate for only one shoulder strap 3 to be connected in this way. This is preferably the shoulder strap 3 arranged on the same side of a human torso as that on which the fastening belt 4 is releasably connected to the carrier strip 16 by means of corresponding fastening loops 20.

Figure 14:
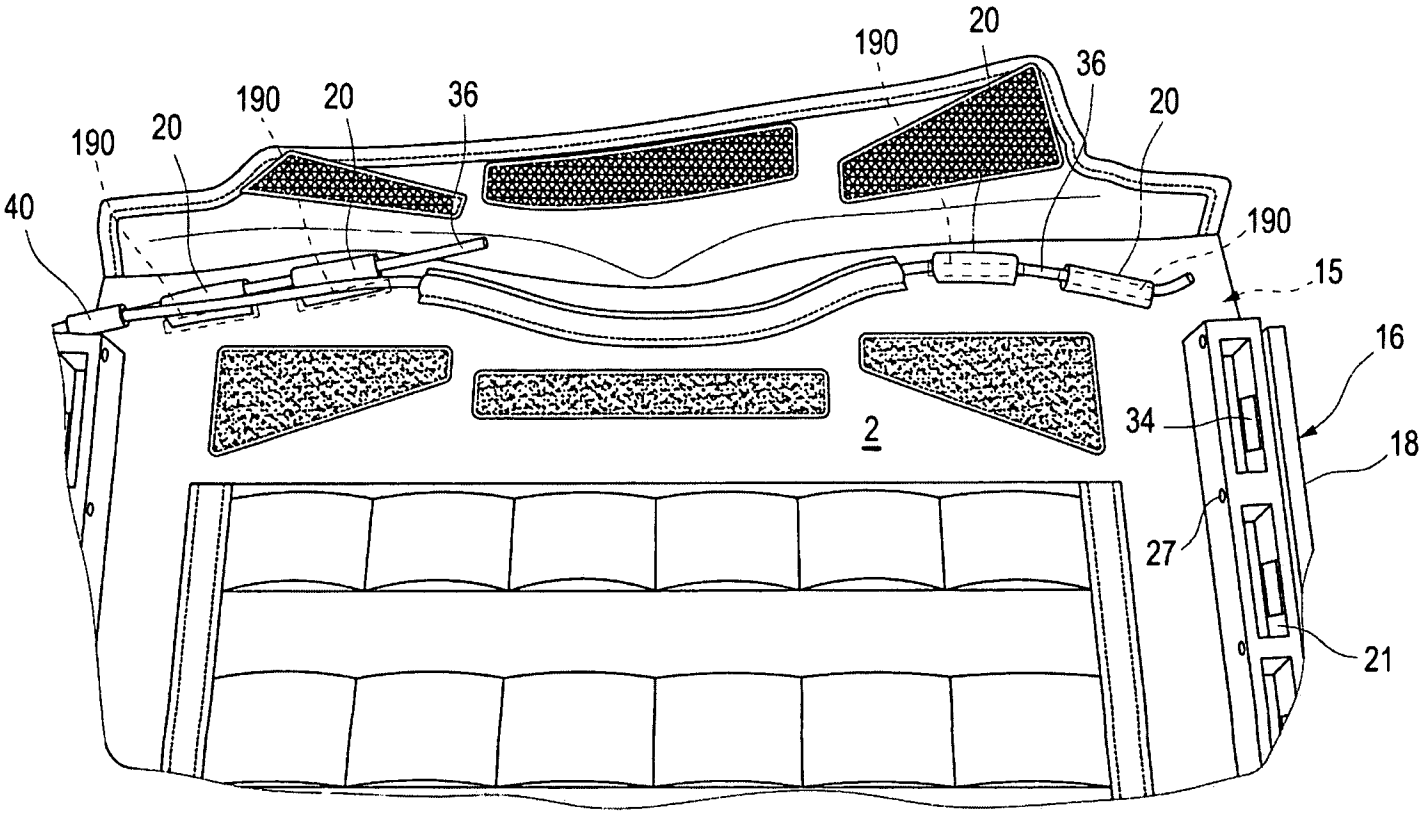
FIG. 14 shows a view of the rear side of a back plate, to which two shoulder straps (not illustrated) are fastened by means of in each case two fastening loops attached to the shoulder straps and by means of in each case one pintle wire, wherein the outer side of the back plate is provided with a textile.
Figure 15:
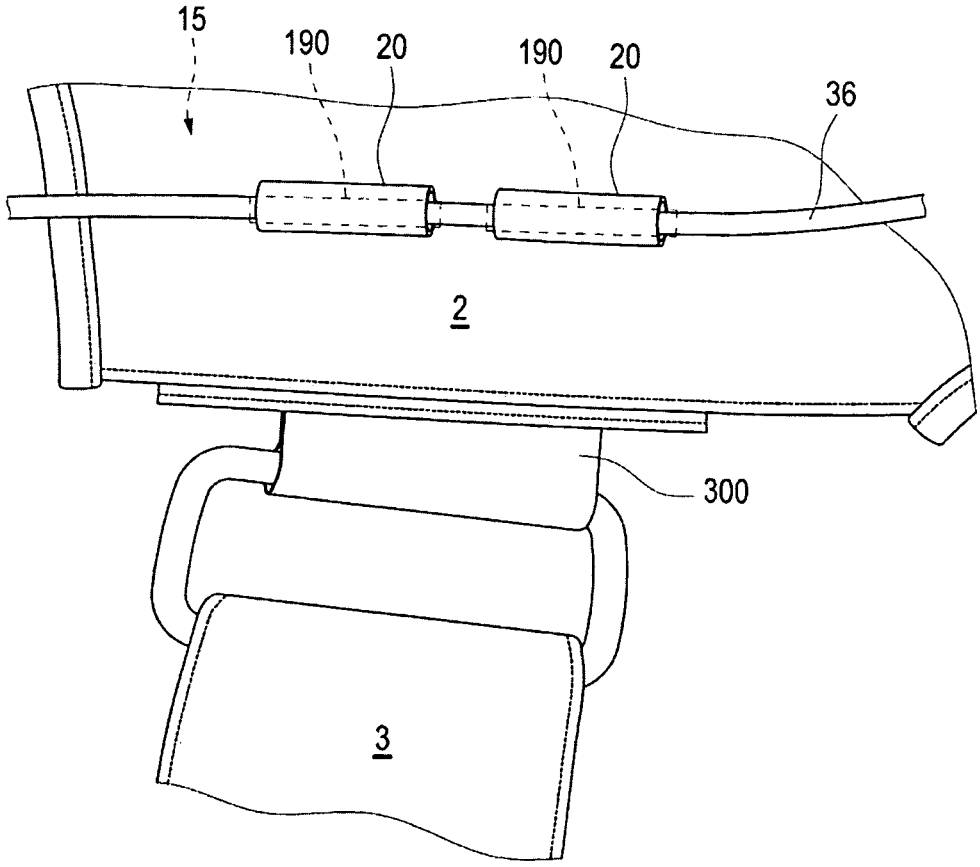
FIG. 15 shows an enlarged illustration of the rear side of a back plate, showing a strap part of a shoulder strap, wherein the strap part is fastened to the back plate by means of fastening loops and a pintle wire.

FIGS. 14 and 15 show a view of the inner side (rear side), which faces away from the torso, of the back plate 15. Here, proceeding from the outer side (front side) of the back plate 15, in each case two fastening loops 20 per shoulder strap 3 are passed through the receiving slots 190 and secured by means of the pintle wire 36. It is also possible here for more than two fastening loops 20 or even only one fastening loop 20 to be provided per shoulder strap 3.

As can be seen from FIG. 14, it may be provided that the pintle wire 36 branches at its end facing towards the fastening loops 20. Here, it may be provided that the branching configuration is produced by means of a clamp 40 or similar auxiliary means, such that the pintle wire 36 has two (or more) ends which fix in each case the fastening loops 20 of one shoulder strap 3. It is basically also possible for the pintle wire 36 to not be branched, that is to say to have only one end, at its end facing towards the fastening loops 20. In this way, when the pintle wire 36 is pulled out, firstly one shoulder strap 3 and then the second shoulder strap 3 is released. As a result of a branching configuration of the pintle wire 36 at its end facing towards the fastening loops 20, each shoulder strap 3 may be assigned a separate end piece. In this way, it can be achieved that both shoulder straps 3 are released preferably approximately simultaneously by pulling out the pintle wire 36.

It is advantageous for the pintle wire 36 to be actuated, or pulled out of the fastening loops 20, by means of an operating part 39. Here, the operating part 39 may preferably be arranged such that a person wearing the carrier system can easily reach the operating part 39. The operating part 39 is for this purpose preferably arranged on the top side or front side of a human torso when the carrier system is worn correctly.

As a result of the optional branching of the ends of the pintle wire 36, it can be achieved here that both shoulder straps 3 are released by the actuation of the operating part 39. Here, the pintle wire 36 which can be pulled out by means of the operating part 39 may also be passed through one or both receptacles 19 of the carrier strips 16, such that the pintle wire 36 can also be pulled out of the one or more receptacles 19 of the carrier strips 16 by means of an actuation of the operating element 39. The pintle wire 36 may for this purpose have a suitable number of branches.

It may alternatively also be provided that the pintle wire 36 which has been inserted into one receptacle 19 or into both receptacles 19 is released by means of a separate operating part 19; in this case, the pintle wire 36 is also formed independently of the pintle wire which releases the shoulder straps. If appropriate, it is also possible for a separate pintle wire to be provided for each shoulder strap or carrier strip.

In the exemplary embodiment, the shoulder strap 3 is not connected directly to the back plate 15. As can be seen in particular from FIGS. 1 and 15, the shoulder strap 3 comprises, at its end facing towards the back plate 15, a strap part 300 which can be releasably connected to the shoulder strap 3 and which has the at least one fastening loop 20 for connecting to the back plate 15 or for inserting into the receptacle 190. The connection between the belt part 300 and the shoulder strap 3 may take place here in the usual way, for example by means of a metal clasp or the like (see FIG. 15).

FIG. 14 shows an advantageous facility for protecting the combination of the fastening loops 20 and the pintle wires 36. For this purpose, the textile which clads the back plate 15 has a flap or a tab which can be fixed preferably by means of a hook-and-loop connection such that the combination of the fastening loops 20 and the pintle wires 36 is arranged under the flap or tab.

As can be seen from a juxtaposition of FIGS. 1 to 4, 7 to 12 and 17 to 19, the carrier strip 16 has a rail 18 for the connection of the lateral supports 6. It is provided here that in each case one lateral support 6 is fastened to a carrier strip 16 or the rail 18 thereof. The lateral support 6 is connected to the back plate 15 or to the back part 2 in this way.

The lateral support 6 may be attached to the carrier strip 16 or to the rail 18 thereof with continuously variable or grid-based vertical adjustability. If a grid is provided, the receiving bores of the grid may be arranged offset at short intervals. It is for example possible for screws of the lateral support 6 to be screwed into the receiving bores. In the embodiment illustrated in FIGS. 7 to 13, it is provided, in a way not illustrated in any more detail, that the lateral support 6 is fixed in a non-positively or positively locking manner to any desired point of the rail 18 by means of a clamping or snap-action connection.

It is also provided in the exemplary embodiment that the lateral support 6 is connected to the associated carrier strip 16 by means of a tongue and groove connection.

The lateral support 6 substantially has a tube 60 and a rod 61 which engages into the tube 60. In a way not illustrated in any more detail, there is also integrated here a damping system which may be realized for example by means of a spring. The inventor has recognized that a lateral support 6 composed substantially only of a tube 60 and a rod 61 is particularly suitable for providing the wearer of the carrier system with an advantageous degree of freedom of movement. The embodiment of lateral supports which engage on more than two points has proven not to be expedient with regard to the freedom of movement of the wearer. The inventor has recognized that it is advantageous for the lateral support to engage only on two points, specifically on the hip belt 5 and on the back part 2.

It may be provided in the exemplary embodiment that the lateral support 6 with the illustrated rod/tube combination 60, 61 is designed such that the relative movement generated by a person between the hip and torso while walking leads to a relative movement of the rod 61 in the tube 60, the rod/tube combination 60, 61 being designed such that a movement of the rod 61 in the tube 60 generates an electrical current. In this regard, reference is made to EP 1 994 841 B1. The arrangement of the rod 61 and of the pipe 60 may self-evidently also be reversed.

It is provided in the exemplary embodiment that the lateral support 6 is pivotably arranged on the back part 2, more precisely on the carrier strip 16 or the rail 18 thereof, by means of two axles 38. The axles 38 by means of which the lateral support 6 is arranged on the carrier strip 16 are designed as hinges in the exemplary embodiment. It is also provided that the lateral support 6 is pivotably arranged on the hip belt 5 likewise by means of two axles 38. These may likewise be two hinges which are preferably at right angles to one another. As an alternative thereto, for the connection to the hip belt 5, it may also be provided that the associated end of the lateral support 6 has a plate with a bore which is pushed onto a bolt, about which the plate with the bore is then rotatable. After the plate is pushed onto the bolt, the plate can be secured by means of a locking pin which can be plugged transversely through the bolt.

It is advantageous for the hip belt 5 to have, in the region of the coccyx, a receptacle 42, a recess, a pocket, a slot or the like which is preferably matched in terms of its shape to a step counter or to a so-called inertial navigation system (INS). Here, the receptacle 42 may preferably be correspondingly cushioned. It is advantageous for the step counter to be fitted, preferably in a positively locking manner, into the receptacle 42 or the like.

The inventor has recognized that the arrangement of a step counter in a hip belt 5 in the area of the coccyx (when the hip belt 5 is being worn correctly by the wearer) is particularly suitable because vibrations and shocks are particularly low in said area and therefore the step counter or the INS operates in a particularly precise manner, as a result of which the position and speed of the person wearing the hip belt 5 can be determined particularly precisely. The step counter may, in one embodiment, be inserted in a positively locking manner into the hip belt 5.

As can be seen from FIG. 19, it is provided in the exemplary embodiment that the receptacle 42 has a flap 43 which can be pivoted open or opened such that a step counter (not illustrated in any more detail) or a corresponding navigation system (INS) can be integrated in the hip belt 5 or inserted into the receptacle 42. Here, the insertion takes place by virtue of the step counter or the navigation system being inserted into the receptacle 42 from the rear and subsequently being closed again by means of the flap 43.

As an alternative thereto, a slot may be advantageous into which the step counter is inserted from above. Here, the opening of the slot may be closed off by means of a flap or a cover.

FIG. 19 shows a particularly advantageous variant of the solution according to the invention, in which it is provided that the carrier system has a water store 41. The water store 41 may basically be arranged at any desired location between the frame 8 and the back plate 15, and if appropriate also between the frame 8 and a rucksack 10. It is however advantageous for the water store 41 to be arranged between a cover 23 illustrated in FIG. 13 and a frame 8 illustrated in FIG. 7. Here, the water store 41 may have a length and a width substantially corresponding to the length and width of the cover 23 and/or of the frame 8. An arrangement of the water store 41 between the frame 8 and the cover 23 is shown in principle in FIG. 19. The water store 41 may have a drinking hose 44 which is guided from the water store 41 preferably over a human shoulder such that the drinking hose can be reached by the mouth of the person wearing the carrier system.

The carrier system described in terms of the exemplary embodiments and illustrated in FIGS. 1 to 19 is not restricted to the illustrated combination of features. The illustrated features may be used both individually and also in any desired combination with one another. This applies in particular to the features mentioned below.

The hip belt 5 may, in particular with the receptacle 42 for the step counter, be used independently of the other features of the carrier system according to the invention. Furthermore, the hip belt 5 may be combined with any desired individual features of the carrier system according to the invention described in the exemplary embodiment.

The fastening belt 4 may also be used independently of the other features of the carrier system according to the invention; in particular, the side part 400 in its function as an adapter part, and in particular the connection of the side part 400 to the fastening belt 4, constitutes an independent inventive solution. The fastening belt 4 is particularly suitable in combination with a back part 2 and a front part 1, but is not restricted to said combination.

The lateral support 6 may also be used for connecting a back part 2 to a hip belt 5 independently of the fastening belt 4 or the connection thereof to the back part 2 and also independently of the connection of the front part 1 to the back part 2 by means of the shoulder strap 3.

The advantageous design of the back part 2, as illustrated for example in FIGS. 7 to 13, constitutes an independent inventive solution regardless of the way in which the lateral support 6 is attached or in which a fastening belt 4 (if required at all) or the shoulder straps 3 (if required at all) are attached thereto. The modular design of the back part 2 with the back plate 15 is independently inventive, in particular with regard to the possibility of the modular arrangement of a housing 7 and/or a frame 8 for carrying loads and/or a water store 41. Furthermore, the facility for connecting the rucksack 10 to the frame 8 is an inventive solution which is independent of all the other features but which may if required be combined in any desired manner with the features or combinations of features of the exemplary embodiment.

The solution according to the invention of the means for fastening a front or back part to a human torso, in particular the described combination of the fastening loops 20 and the elongate fixing element 36, can also be used independently of the other features, described in detail, of the carrier system as illustrated in the exemplary embodiment. The means 3, 4 having the fastening loops 20 and the elongate fixing element 36 may be combined in any desired manner with features or combinations of features of the exemplary embodiment.

The solution according to the invention is particularly suitable in an embodiment as a protective vest, wherein in this case the front part 1 constitutes the front part of the protective vest and the back part 2 constitutes the rear part of the protective vest.

Figure 20:
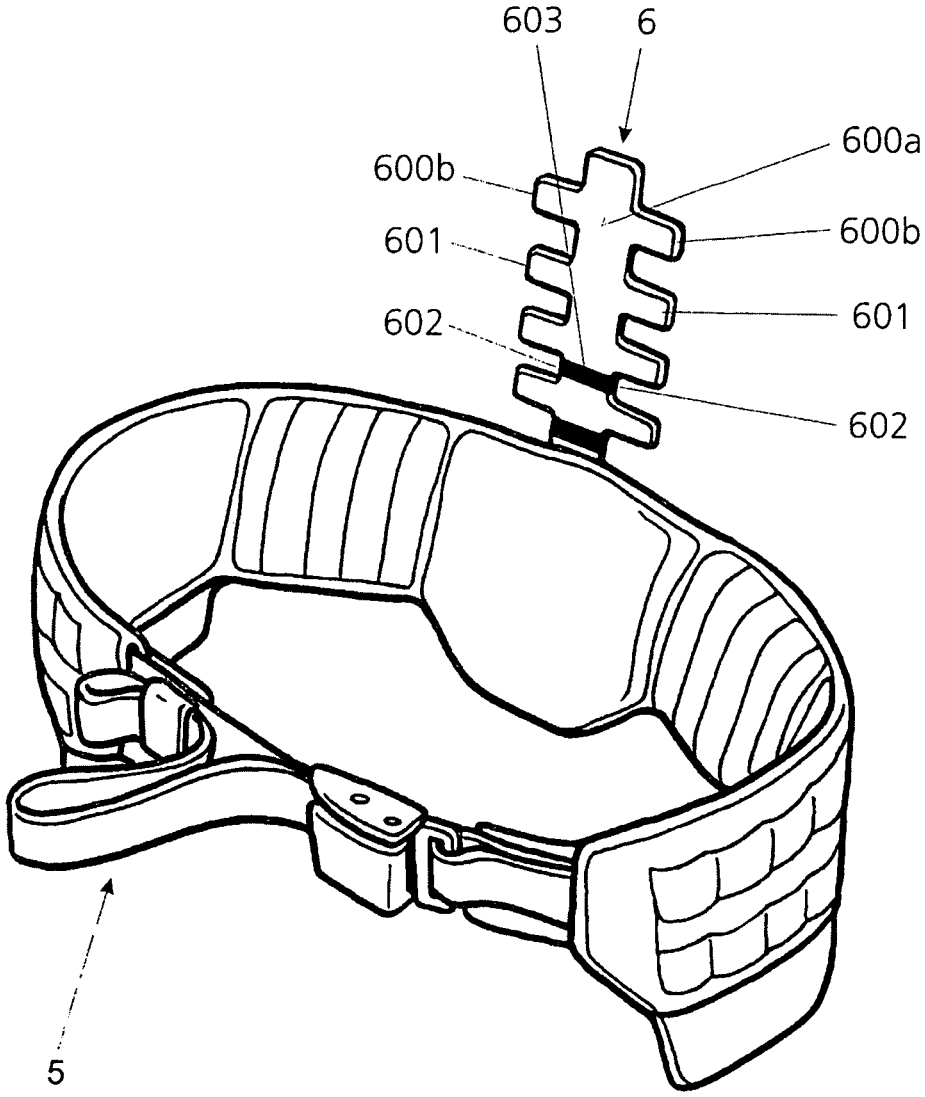
FIG. 20 shows a hip belt with an alternative configuration of the support.

FIG. 20 shows an alternative embodiment of the hip belt 5. The hip belt 5 may be combined with the embodiments which have been described above on the basis of FIGS. 1 to 19. The hip belt according to FIG. 20 differs from the hip belt described above by the embodiment of the support 6. The support 6 is designed to transmit weight loads from the back part 2 to the hip belt 5. The support 6 runs on the rear side of the hip belt 5 up the back of the wearer along a spine (not illustrated) of a wearer when the hip belt 5 is correctly fastened. Here, the upper region, which faces away from the hip belt 5, of the support 6 can be connected to the back part 2 (not illustrated).

The support 6 may be of partially or entirely resilient and/or elastic design. FIG. 20 shows an optional embodiment in which the support has a substantially flat, plate-like structure, wherein the two main surfaces 600*a* extend substantially plane-parallel to the rear side of the back part 2, and wherein the two laterally and vertically running side edges 600*b* of the support 6 each have a mirror-symmetrically arranged, sawtooth-like profile section. Here, the sawtooth-like profile section forms projections 601 and grooves 602. This is optional. The grooves 602 and the projections 601 of the side edges 600*b* are optionally situated preferably in each case mirror-symmetrically opposite one another, as illustrated in FIG. 20. The formation of the side edges 600*b* with a sawtooth-like profile has proven to be particularly suitable with regard to the connection (not illustrated) of the support to the back part 2. Here, a good connection can be produced in particular by means of hook-and-loop connecting elements if the hook-and-loop connecting elements are attached to the back part 2 and are suitable for running in the grooves 602. It is optionally possible for a part 603 of the support 6 to be of elastic or resilient design preferably between two mirror-symmetrically arranged grooves 602 of the profile sections. It is self-evidently also possible for a plurality of elastic or resilient parts to be formed. The parts may for example be formed from rubber or natural rubber.

In the exemplary embodiment, the means 3, 4 for fastening to a human torso are formed as first fastening means which are designed as fastening loops 20. The second fastening means provided on the back part 2 are designed as receptacles 19, 190 with slots 35. The first fastening means may however also be designed at least partially as receptacles 19, 190, and the corresponding second fastening means of the back part may also be formed as fastening loops 20. This is not illustrated in the figures but is easily conceivable. For example, with regard to the design of the means 3, that is to say of the shoulder strap, it may be provided that these, at their end, have not fastening loops 20 but rather receptacles 190 in the form of eyelets or the like. Conversely, the second fastening means on the back part 2 may easily be formed as fastening loops. Here, the fastening loops 20 may for example be screwed to the back part 2. The fastening loops 20 of the back part 2 may then be passed through the receptacles 190 of the shoulder strap 3 and fixed, in the manner already described, by means of the elongate fixing element 36. The fastening loops 20 may be fastened to the back part in any desired manner.

Similarly, it is also optionally, alternatively or additionally possible for the means 4, in the exemplary embodiment of the fastening belt, to have receptacles 19, for example in the form of eyelets. Here, the back part 2 may in turn have fastening loops 20 which are passed through the eyelets or the receptacles 19 of the fastening belt and are subsequently fixed by means of the elongate fixing element.

What is claimed is:

1. A carrier system for use on a human torso, comprising:

a back part which is located, and releasably supported on, a back of a human torso, and wherein the back part has a receptacle in the form of an elongated continuous tube having opposite ends, and which has a longitudinally extending and continuous slot formed therein, and which extends between the opposite ends of the elongated continuous tube;

a hip belt which is affixed to the back part, and which is further oriented on and about a pair of hips of the human torso, and wherein the hip belt further has opposite ends which are releasably coupled together to secure the hip belt about a waist of the human torso;

a fastening belt having a pair of flank portions, and wherein each flank portion has a first end which is releasably coupled to the back part, and a second end which extends around the human torso and is located in close proximity to the second end of other flank portion, and wherein the first end of each flank portion includes a flexible loop, and which is inserted through the longitudinally extending and continuous slot, and is received, at least in part, within the elongated continuous tube, and wherein the fastening belt is located elevationally, above the hip belt, and the second end of each of the flank portions of the fastening belt are releasably fastened together at a location which is between the waist of the human torso, and a pair of shoulders of the human torso, and wherein the fastening belt is operable to stabilize the back part as the human torso moves; and an elongated fixing element which is dimensioned to be received within the elongated continuous tube and which further extends through the portion of the flexible loop which is inserted through the continuous longitudinally extending slot, and received within the elongated continuous tube, and wherein the elongated fixing element, once received within the flexible loop, prohibits the flexible loop from being removed from the elongated continuous tube and releasably secures the respective flank portions of the fastening belt to the back part.

2. A carrier system for use with a human torso, comprising:

a back plate which is located, and releasably supported on, a back of a human torso, and wherein the back plate has spaced, laterally oriented, and generally vertically disposed peripheral edges when the back plate is worn on the back of a human torso which is standing in a generally upright position;

a hip belt which is releasably affixed to the back plate, and which is further oriented on and about a pair of hips of the human torso;

a fastening belt having a pair of flank portions, and wherein each flank portion is releasably attached to the back plate, and wherein the respective flank portions wrap around the human torso, and releasably secure the back plate to the human torso at a location between the hip belt, and a pair of shoulders of the human torso;

an elongated carrier strip which is fastened to, and which further extends, at least in part, along, and generally perpendicularly, outwardly relative to, each of the laterally oriented, and vertically disposed peripheral edges of the back plate;

a ballistically resistant base plate which has a pair of laterally oriented, and generally vertically disposed peripheral edges, and wherein the peripheral edges of the ballistically resistant base plate are individually, releasably attached to the respective elongated carrier strips that are mounted along the laterally oriented peripheral edges of the back plate, and wherein the ballistically resistant base plate forms a portion of a housing which encloses at least one electrical component, and wherein the ballistically resistant base plate is disposed in spaced relation relative to the back plate; and a step-resistant cover mounted outwardly, and in spaced relation relative to, the ballistically resistant base plate, and on the housing which is made integral with the base plate, and wherein the step-resistant cover protects the at least one electrical component from damage by resisting deformation when an exterior force is applied to the step-resistant cover.

* * * * *